US010065763B2

(12) United States Patent
Wilcox

(10) Patent No.: US 10,065,763 B2
(45) Date of Patent: Sep. 4, 2018

(54) WALL LATCHING SYSTEM

(71) Applicant: Arena Packaging, LLC, Rochester, NY (US)

(72) Inventor: Donald E. Wilcox, Rochester, NY (US)

(73) Assignee: Arena Packaging, LLC, Rochester, NY (US)

( * ) Notice: Subject to any disclaimer, the term of this patent is extended or adjusted under 35 U.S.C. 154(b) by 204 days.

(21) Appl. No.: 15/266,683

(22) Filed: Sep. 15, 2016

(65) Prior Publication Data

US 2018/0072455 A1 Mar. 15, 2018

(51) Int. Cl.

| | |
|---|---|
| ***B65D 6/18*** | (2006.01) |
| ***B65D 21/08*** | (2006.01) |
| ***B65D 21/02*** | (2006.01) |
| ***B65D 85/34*** | (2006.01) |

(52) U.S. Cl.

CPC ..... *B65D 11/1833* (2013.01); *B65D 21/0201* (2013.01); *B65D 21/086* (2013.01); *B65D 85/34* (2013.01)

(58) Field of Classification Search

CPC ..... B65D 11/1833; B65D 11/184; B65D 11/1846; B65D 11/1853; B65D 11/186; B65D 11/18; B65D 21/0201; B65D 21/086; B65D 85/34

USPC ..... 220/7

See application file for complete search history.

(56) References Cited

U.S. PATENT DOCUMENTS

| | | | |
|---|---|---|---|
| 2,547,672 | A | 4/1951 | Spanjer |
| 3,150,791 | A | 9/1964 | Shile et al. |
| 3,525,451 | A | 8/1970 | Asser |
| 3,692,342 | A | 9/1972 | Scallan |
| 3,955,703 | A | 5/1976 | Zebarth |
| 3,966,072 | A | 6/1976 | Gonzales et al. |
| 3,982,652 | A | 9/1976 | Nordgren |
| 3,999,676 | A | 12/1976 | Trebilcock et al. |
| 4,005,795 | A | 2/1977 | Mikkelsen et al. |
| 4,044,910 | A | 8/1977 | Box |
| 4,050,606 | A | 9/1977 | Jurasek |
| 4,062,467 | A | 12/1977 | Friedrich |
| 4,240,555 | A | 12/1980 | Jurasek |

(Continued)

FOREIGN PATENT DOCUMENTS

| | | | |
|---|---|---|---|
| CA | 1024118 | A | 10/1978 |
| CA | 1054078 | A | 5/1979 |

(Continued)

*Primary Examiner* — Andrew Perreault

(74) *Attorney, Agent, or Firm* — Bond, Schoeneck & King PLLC; Jeffrey Powers

(57) ABSTRACT

A container comprising walls. A first wall has a latch connected thereto by a flexible arm at a first lateral end. The latch comprises i) a latch body connected to the flexible arm and resiliently, outwardly movable, the latch body having an interior surface sloped to partially face a second lateral end of the first wall, and ii) a stop contact having a contact surface resiliently movable relative to the latch body. The stop contact is connected to the latch body at a location outward of where a stop contacts the contact surface. A second wall comprising a stop is located at the first lateral end, and is movable on a hinge. The stop is aligned to contact the contact surface as the second wall is rotated from an erected arrangement and to contact the interior surface as the second wall is rotated from the collapsed arrangement.

4 Claims, 28 Drawing Sheets

(56) References Cited

U.S. PATENT DOCUMENTS 4,630,746 A 12/1986 Fortenberry
4,674,647 A 6/1987 Gyenge et al.
4,693,386 A 9/1987 Hughes et al.
4,715,508 A 12/1987 Schurch
4,735,330 A 4/1988 Hoss
4,735,331 A 4/1988 Keenan et al.
4,775,068 A 10/1988 Reiland et al.
4,917,255 A 4/1990 Foy et al.
4,923,079 A 5/1990 Foy
4,960,223 A 10/1990 Chiang et al.
4,967,927 A 11/1990 Reiland et al.
5,094,356 A 3/1992 Miller
5,114,037 A 5/1992 Hillis et al.
5,161,709 A 11/1992 Oestreich, Jr.
5,277,785 A 1/1994 Van Anglen
5,398,835 A 3/1995 Blinstrub
5,413,236 A 5/1995 Kenevan
5,452,817 A 9/1995 Taravella et al.
5,467,885 A 11/1995 Blinstrub
5,474,197 A 12/1995 Hillis et al.
5,515,987 A 5/1996 Jacques et al.
5,539,956 A 7/1996 Wallace
5,586,675 A 12/1996 Borsboom et al.
5,588,549 A 12/1996 Furtner
5,595,318 A 1/1997 Barno
5,601,202 A 2/1997 Meacham et al.
5,632,392 A 5/1997 Oh
5,711,444 A 1/1998 Meacham et al.
5,765,707 A 6/1998 Kenevan
5,788,103 A 8/1998 Wagner et al.
D400,711 S 11/1998 Hwang
5,829,617 A 11/1998 Umiker
5,853,099 A 12/1998 Lessard
5,862,931 A 1/1999 Cox et al.
5,865,334 A 2/1999 Ruiz et al.
5,938,059 A 8/1999 Luburic
5,971,187 A 10/1999 Clee et al.
5,992,673 A 11/1999 Hwang
6,015,056 A 1/2000 Overholt et al.
6,036,049 A 3/2000 Hwang
6,073,790 A 6/2000 Umiker
6,098,827 A 8/2000 Overholt et al.
6,138,851 A 10/2000 Townson
6,202,884 B1 3/2001 Verkerke
D446,392 S 8/2001 Overholt et al.
6,283,319 B1 9/2001 Hillis et al.
6,286,701 B1 9/2001 Umiker
6,290,081 B1 9/2001 Merey
6,293,418 B1 9/2001 Ogden et al.
6,305,726 B1 10/2001 LeTrudet
D452,614 S 1/2002 Overholt
6,338,181 B1 1/2002 Hwang
6,386,388 B1 5/2002 Overholt
6,394,296 B1 5/2002 Elvin-Jensen et al.
D458,753 S 6/2002 Overholt et al.
6,398,054 B1 6/2002 Overholt et al.
6,409,041 B1 6/2002 Overholt et al.
6,422,409 B2 7/2002 Kofod
6,439,414 B1 8/2002 Liu
6,446,825 B1 9/2002 Godoy
6,460,717 B1 10/2002 Smyers et al.
6,484,898 B2 11/2002 Hillis et al.
6,540,096 B1 4/2003 Bazany et al.
D478,421 S 8/2003 Overholt et al.
6,601,724 B1 8/2003 Koefelda et al.
6,631,822 B1 10/2003 Overholt
6,722,515 B2 4/2004 Rumpel
6,722,516 B1 4/2004 Zelko
6,772,897 B2 8/2004 Kellerer et al.
6,843,386 B2 1/2005 Raghunathan et al.
6,863,180 B2 3/2005 Apps et al.
6,899,242 B2 5/2005 Overholt et al.
6,913,161 B2 7/2005 Schafer
6,918,502 B1 7/2005 Overholt et al.
6,918,508 B2 7/2005 Hwang
7,011,225 B2 3/2006 Oster et al.
7,017,765 B2 3/2006 Overholt
7,017,766 B2 3/2006 Hsu et al.
7,032,765 B2 4/2006 Miller et al.
7,044,319 B2 5/2006 Overholt et al.
7,048,134 B1 5/2006 Hagan
7,048,135 B2 5/2006 Smyers et al.
7,059,489 B2 6/2006 Apps et al.
7,086,555 B2 8/2006 Overholt et al.
7,100,786 B2 9/2006 Smyers
7,104,414 B2 9/2006 Apps et al.
7,128,231 B2 10/2006 Overholt
7,152,751 B2 12/2006 Bartasevich, Jr. et al.
7,159,730 B2 1/2007 Rumpel
7,195,127 B2 3/2007 Hsu et al.
7,195,128 B2 3/2007 Murakami et al.
7,240,799 B2 7/2007 Zhang
7,264,122 B2 9/2007 Koefelda et al.
7,311,220 B2 12/2007 Kellerer
7,350,661 B2 4/2008 Endou
7,353,962 B2 4/2008 Parnall et al.
7,357,269 B2 4/2008 Apps
7,428,973 B2 9/2008 Barth et al.
7,478,726 B2 1/2009 Apps et al.
7,484,634 B2 2/2009 Apps
7,549,550 B2 7/2009 Smyers et al.
7,556,165 B2 7/2009 McDade
7,556,166 B2 7/2009 Pamall et al.
D600,020 S 9/2009 Cope
7,641,066 B2 1/2010 Baltz
7,694,836 B2 4/2010 Overholt et al.
7,699,212 B2 4/2010 Turvey et al.
RE41,323 E 5/2010 Kellerer et al.
7,708,160 B2 5/2010 Booth et al.
7,717,283 B2 5/2010 Apps et al.
7,726,502 B2 6/2010 Apps
7,740,146 B2 6/2010 Cavalcante et al.
7,784,632 B2 8/2010 Truong
7,861,458 B2 1/2011 Apps et al.
7,861,878 B2 1/2011 Escarpa Gil
7,861,879 B2 1/2011 Samprathi
7,886,926 B2 2/2011 Orgeldinger
7,896,184 B2 3/2011 Meers
7,963,397 B2 6/2011 Seagle et al.
8,033,411 B2 10/2011 Turvey et al.
8,052,000 B2 11/2011 Apps
8,056,723 B2 11/2011 Cavalcante
8,066,136 B2 11/2011 Turvey et al.
8,066,147 B2 11/2011 Meers et al.
8,113,372 B2 2/2012 Bellehumeur et al.
8,146,763 B2 4/2012 Turvey et al.
8,146,773 B2 4/2012 Turvey et al.
D661,901 S 6/2012 Orgeldinger
8,205,763 B2 6/2012 Fredrickson
D663,121 S 7/2012 Barth
8,235,008 B2 8/2012 Axelrod et al.
8,261,923 B2 9/2012 Blanchard
8,267,270 B2 9/2012 Samprathi
D670,081 S 11/2012 Orgeldinger
8,317,045 B2 11/2012 Cavalcante
8,342,347 B2 1/2013 Hay
8,348,076 B2 1/2013 Rader et al.
8,381,929 B2 2/2013 Kellerer et al.
8,387,813 B2 3/2013 Ringler
8,413,831 B2 4/2013 Nolan
8,424,710 B2 4/2013 Orgeldinger
8,434,618 B2 5/2013 Mitchell et al.
8,469,216 B2 6/2013 Pils
8,469,224 B2 6/2013 Orgeldinger
8,485,376 B2 7/2013 Samprathi
8,511,496 B2 8/2013 Van Der Korput et al.
8,511,506 B2 8/2013 Ringler
D689,694 S 9/2013 Barth
D692,238 S 10/2013 Orgeldinger
8,561,836 B2 10/2013 Cook
8,573,427 B2 11/2013 Lam
8,579,147 B2 11/2013 Dubois et al.
8,584,883 B2 11/2013 Escarpa Gil
8,627,973 B2 1/2014 Dekkers

(56) References Cited

U.S. PATENT DOCUMENTS

| | | | |
|---|---|---|---|
| 8,640,912 | B2 | 2/2014 | Orgeldinger |
| 8,646,639 | B2 | 2/2014 | Pils et al. |
| 8,651,310 | B2 | 2/2014 | Orgeldinger |
| 8,662,333 | B2 | 3/2014 | Orgeldinger |
| 8,672,137 | B2 | 3/2014 | Seagle et al. |
| D701,698 | S | 4/2014 | Orgeldinger |
| 8,684,209 | B2 | 4/2014 | Choi |
| 8,720,692 | B2 | 5/2014 | Apps |
| 8,727,158 | B2 | 5/2014 | Nolan |
| 8,727,165 | B2 | 5/2014 | Nolan |
| D707,547 | S | 6/2014 | Orgeldinger |
| 8,757,412 | B2 | 6/2014 | Sommer et al. |
| 8,783,489 | B2 | 7/2014 | Bellehumeur et al. |
| 8,789,715 | B2 | 7/2014 | Shea et al. |
| 8,807,365 | B2 | 8/2014 | Orgeldinger |
| 8,807,367 | B2 | 8/2014 | Bobritski |
| 8,820,560 | B2 | 9/2014 | Nolan |
| 8,844,740 | B2 | 9/2014 | Nemoto et al. |
| 8,844,753 | B2 | 9/2014 | Starnes |
| 8,863,971 | B2 | 10/2014 | Cavalcante et al. |
| 8,870,008 | B2 | 10/2014 | Wu et al. |
| 8,875,924 | B2 | 11/2014 | Orgeldinger |
| 8,978,921 | B2 | 3/2015 | Orgeldinger |
| 9,016,492 | B2 | 4/2015 | Orgeldinger |
| 9,033,171 | B2 | 5/2015 | Bobritski |
| 9,242,761 | B2 | 1/2016 | Iwata |
| 9,278,775 | B2 | 3/2016 | Meers et al. |
| 9,302,811 | B2 | 4/2016 | Orgeldinger |
| 9,327,870 | B2 | 5/2016 | Jian et al. |
| 9,371,154 | B2 | 6/2016 | Samprathi |
| 9,403,621 | B2 | 8/2016 | Dubois et al. |
| 9,415,898 | B2 | 8/2016 | Nolan |
| 9,422,082 | B2 | 8/2016 | Nolan et al. |
| 9,422,087 | B1 | 8/2016 | Poran et al. |
| 9,469,429 | B2 | 10/2016 | Orgeldinger |
| 2002/0108950 | A1 | 8/2002 | Moorman et al. |
| 2002/0130132 | A1 | 9/2002 | Overholt |
| 2003/0075541 | A1 | 4/2003 | Bartasevich, Jr. et al. |
| 2003/0146213 | A1 | 8/2003 | Kellerer et al. |
| 2003/0222081 | A1 | 12/2003 | Apps et al. |
| 2004/0069780 | A1* | 4/2004 | Apps ..... B65D 11/1833 220/7 |
| 2004/0153209 | A1 | 8/2004 | Muller |
| 2005/0150892 | A1 | 7/2005 | Miller |
| 2005/0155967 | A1 | 7/2005 | Vial |
| 2005/0194382 | A1 | 9/2005 | B. |
| 2006/0054528 | A1 | 3/2006 | Sanzana et al. |
| 2006/0096981 | A1 | 5/2006 | Schafer |
| 2007/0029319 | A1 | 2/2007 | Speck |
| 2007/0045331 | A1 | 3/2007 | Schafer |
| 2007/0095842 | A1 | 5/2007 | Apps |
| 2007/0125779 | A1 | 6/2007 | Cope |
| 2007/0189932 | A1 | 8/2007 | Glenn et al. |
| 2007/0194023 | A1 | 8/2007 | Apps et al. |
| 2007/0272579 | A1 | 11/2007 | Cavalcante |
| 2008/0169285 | A1 | 7/2008 | Marazita et al. |
| 2008/0296308 | A1 | 12/2008 | Barbalho et al. |
| 2008/0308552 | A1 | 12/2008 | Cavalcante et al. |
| 2009/0078701 | A1 | 3/2009 | Cavalcante |
| 2009/0101640 | A1 | 4/2009 | Hadar |
| 2009/0194530 | A1 | 8/2009 | Ringler |
| 2009/0206149 | A1 | 8/2009 | Cavalcante |
| 2009/0223953 | A1 | 9/2009 | Cavalcante |
| 2009/0236337 | A1 | 9/2009 | Orgeldinger |
| 2009/0261092 | A1 | 10/2009 | Blanchard |
| 2009/0302046 | A1 | 12/2009 | Roberts, Sr. et al. |
| 2010/0012654 | A1 | 1/2010 | Apps |
| 2010/0018966 | A1 | 1/2010 | Roberts, Sr. et al. |
| 2010/0044371 | A1 | 2/2010 | Koefelda |
| 2010/0065558 | A1 | 3/2010 | Cavalcante et al. |
| 2010/0133266 | A1 | 6/2010 | Cook et al. |
| 2011/0006057 | A1 | 1/2011 | Cavalcante |
| 2011/0049144 | A1 | 3/2011 | Koefelda et al. |
| 2011/0084083 | A1 | 4/2011 | Baltz et al. |
| 2011/0108558 | A1 | 5/2011 | Magni et al. |
| 2011/0139775 | A1 | 6/2011 | Nolan |
| 2011/0174809 | A1 | 7/2011 | Dubois et al. |
| 2011/0240657 | A1 | 10/2011 | Orgeldinger |
| 2011/0240660 | A1 | 10/2011 | Orgeldinger |
| 2011/0290811 | A1 | 12/2011 | Koefelda et al. |
| 2012/0012492 | A1 | 1/2012 | Darden |
| 2012/0024820 | A1 | 2/2012 | Geugelin |
| 2012/0067880 | A1 | 3/2012 | Orgeldinger |
| 2012/0285951 | A1 | 11/2012 | Cavalcante |
| 2013/0140307 | A1 | 6/2013 | Ringler |
| 2013/0193153 | A1 | 8/2013 | Baltz et al. |
| 2013/0213854 | A1 | 8/2013 | Orgeldinger et al. |
| 2013/0213855 | A1 | 8/2013 | Orgeldinger et al. |
| 2013/0299490 | A1 | 11/2013 | Hansen et al. |
| 2013/0320007 | A1 | 12/2013 | Orgeldinger |
| 2014/0055018 | A1 | 2/2014 | Shein et al. |
| 2014/0224795 | A1 | 8/2014 | Parnall |
| 2014/0251992 | A1 | 9/2014 | Cavalcante |
| 2014/0252018 | A1 | 9/2014 | Nolan |
| 2014/0326718 | A1 | 11/2014 | Lui |
| 2015/0014310 | A1 | 1/2015 | Liu et al. |
| 2015/0028027 | A1 | 1/2015 | Cavalcante et al. |
| 2015/0284135 | A1 | 10/2015 | Vergottini et al. |
| 2016/0009445 | A1 | 1/2016 | Birchmeier |
| 2016/0039603 | A1 | 2/2016 | Gonzalez |
| 2016/0083138 | A1 | 3/2016 | Turner |
| 2016/0101896 | A1 | 4/2016 | White |
| 2016/0229583 | A1 | 8/2016 | Tsamourgelis |
| 2016/0272364 | A1 | 9/2016 | Jian et al. |

FOREIGN PATENT DOCUMENTS

| | | | |
|---|---|---|---|
| CA | 1054077 | A | 8/1979 |
| CA | 2910152 | A1 | 10/2014 |
| CA | 2910132 | A1 | 9/2015 |
| CH | 700586 | B1 | 9/2010 |
| DE | 3327069 | A1 | 5/1984 |
| DE | 3413223 | A1 | 10/1985 |
| DE | 19915639 | A1 | 10/2000 |
| DE | 102004055863 | A1 | 5/2006 |
| DE | 102011001656 | A1 | 9/2012 |
| DE | 102015100886 | A1 | 7/2016 |
| EP | 0294080 | A2 | 7/1988 |
| EP | 0546482 | A2 | 6/1993 |
| EP | 0655392 | A2 | 5/1995 |
| EP | 0690003 | A1 | 3/1996 |
| EP | 0690004 | A1 | 3/1996 |
| EP | 1205355 | A2 | 5/2002 |
| EP | 1637462 | A1 | 3/2006 |
| EP | 1710165 | A2 | 10/2006 |
| EP | 1028061 | B1 | 8/2007 |
| EP | 1894849 | A1 | 3/2008 |
| EP | 2036825 | A1 | 3/2009 |
| EP | 2128035 | A1 | 12/2009 |
| EP | 2256049 | A1 | 12/2010 |
| EP | 2256051 | A1 | 12/2010 |
| EP | 2072413 | B1 | 1/2011 |
| EP | 2371726 | A1 | 10/2011 |
| EP | 2384989 | A2 | 11/2011 |
| EP | 2384990 | A2 | 11/2011 |
| EP | 2311744 | B1 | 6/2012 |
| EP | 2078679 | B1 | 8/2012 |
| EP | 2511460 | A1 | 10/2012 |
| EP | 2548809 | A1 | 1/2013 |
| EP | 2431283 | B1 | 8/2013 |
| EP | 2168883 | B1 | 9/2014 |
| EP | 2431299 | B1 | 9/2014 |
| EP | 2840034 | A1 | 2/2015 |
| EP | 2993141 | A1 | 3/2016 |
| FR | 2609306 | A1 | 7/1988 |
| FR | 2921044 | A1 | 3/2009 |
| GB | 974538 | A | 11/1964 |
| GB | 1178719 | A | 1/1970 |
| GB | 1285001 | A | 8/1972 |
| GB | 1424890 | A | 2/1976 |
| GB | 2337985 | A | 8/1998 |
| GB | 2359066 | A | 8/2001 |
| GB | 2426237 | A | 11/2006 |
| GB | 2446027 | A | 7/2008 |

(56) References Cited

FOREIGN PATENT DOCUMENTS

| | | | |
|---|---|---|---|
| GB | 2452133 | A | 2/2009 |
| GB | 2453668 | A | 4/2009 |
| GB | 2476856 | A | 7/2011 |
| GB | 2507321 | A | 4/2014 |
| JP | 2000335572 | A | 12/2000 |
| JP | 2001341736 | A | 12/2001 |
| JP | 2002255164 | A | 9/2002 |
| JP | 2002308261 | A | 10/2002 |
| JP | 2002370736 | A | 12/2002 |
| JP | 2004001851 | A | 1/2004 |
| JP | 2010030610 | A | 2/2010 |
| JP | 2011121631 | A | 6/2011 |
| JP | 2015013690 | A | 1/2015 |
| JP | 2015027890 | A | 2/2015 |
| JP | 2015027891 | A | 2/2015 |
| JP | 2015110430 | A | 6/2015 |
| NZ | 614453 | A | 2/2015 |
| WO | 9632333 | A1 | 10/1996 |
| WO | 9720742 | A1 | 6/1997 |
| WO | 9933711 | A1 | 7/1999 |
| WO | 2005056399 | A1 | 6/2005 |
| WO | 2006051559 | A1 | 5/2006 |
| WO | 2006116824 | A2 | 9/2006 |
| WO | 2011050828 | A1 | 5/2011 |
| WO | 2011120887 | A1 | 10/2011 |
| WO | 2011120888 | A1 | 10/2011 |
| WO | 2011120889 | A1 | 10/2011 |
| WO | 2012107088 | A1 | 8/2012 |

* cited by examiner

WALL LATCHING SYSTEM

FIELD OF THE INVENTION

Wall latching systems, particularly wall latching systems having a predetermined failure mode.

BACKGROUND OF THE INVENTION

Bananas are harvested in the tropical regions such as Central and South America for consumption in consuming regions, such as North America. Consuming regions have different packing specifications. For example, North American retailers of bananas specify the shipment of bananas on standard GMA (Grocery Manufacturers Association) pallets with a nominal footprint of 48"×40". North American retailers further specify that bananas be packaged in increments of 40 lbs. net product weight delivered to retail distribution centers. Bananas are typically shipped in refrigerated intermodal containers via container ships from ports in South and Central America, then over roads to distributions centers.

The industry-standard method for packaging bananas for shipment to North American retailers has been to pack in corrugated cardboard boxes that have been tailored to this application. Corrugated boxes for bananas are of a 2-piece construction with outside dimensions of about 19.7" (50 cm) in length×15.75" (40 cm) in width×9.69" (24.6 cm) in height. The 2-piece boxes include a bottom and a top cover that telescopes the full height of the bottom to contribute to stacking strength due to the resultant double-wall construction. Corrugated boxes weigh approximately 3 lbs. each.

Bananas are cut from stems into clusters of 4 to 9 banana fingers; each cluster having 2 rows of bananas referred to as the inner whirl on the concave side of the cluster and the outer whirl on the convex side of the cluster. Boxes are typically packed with 15 to 17 clusters per box to meet the net weight specification for major North American retailers. These clusters are packed in 3 or 4 lines or rows of fruit. Packing of the bananas causes flexible boxes to bulge in all directions.

In the past, attempts have been made to duplicate the dimensions of the corrugated box with a rigid, 5-sided, open-top Reusable Plastic Containers (RPCs). The RPC include a base coupled to four walls, two sidewalls and two endwalls. Typically, RPCs are collapsible. Collapsible RPCs provide a "collapsed" arrangement and an "erected" arrangement. The sidewalls and endwalls are connected to the base by hinges which allows the walls to attain the collapsed arrangement where the walls are folded onto the base and achieve an orientation generally parallel to the base, and allows the walls attain the erected arrangement by raising the walls to an orientation generally perpendicular to the base. A latching system including a latch and corresponding stop are used to couple the sidewalls to adjacent endwalls and thereby maintain the erected configuration of the container.

In the past, attempts made to duplicate the dimensions of the corrugated box with a more rigid, 5-sided, open top Reusable Plastic Containers (RPCs) have proven to be unsuccessful in shipping bananas.

Rigid RPCs with 4 walls and a base are designed to handle stacking loads transferred through the walls and base of containers to the pallet with a safety margin to achieve many years of life. The rigid nature of the RPC exacerbates packing damage and damage associated with transporting the requisite quantity of bananas.

To address the weight restrictions on the container and to reduce the amount of packing damage, RPC containers have been made to be more flexible, more in the manner of a corrugated cardboard box than conventional rigid RPCs. To achieve greater flexibility, the thicknesses of walls have been reduced, and rigidizing features such as ribs in the walls have been reduced in number and positioned to allow greater flexibility of the walls.

While such design choices address concerns such as weight and damage to fruit, they present challenges in maintaining sufficient integrity of the erected boxes.

Additional complications of container design arise when containers are to be used with automatic washing systems. Known systems allow for washing with jets of water and scrubbing in a conventional manner, and frequently include apparatus to automatically collapse the walls of the containers without manual operation of the latches that maintain the boxes in an erected arrangement. Automatic collapsing occurs with application of an impulse force (e.g., a force generated by swinging of an arm having a weight attached to an end of the arm) onto a wall of the container to cause the latch to fail without undue damage to the latch. This manner of collapsing a container is commonly referred to as slap down or knockdown.

BRIEF SUMMARY OF THE INVENTION

A particular challenge occurs in collapsible RPC containers that have been made to be more flexible in the manner of a corrugated cardboard boxes. While the latch features on one wall of such containers are intended to interact with the latch features on a neighboring wall to prevent movement of the walls and thereby maintain the erected configuration, a decrease in robustness of the container due to increased flexibility of the walls may result in an increase in the likelihood of inadvertent failure of the latches during dropping or other mishandling.

Another particular challenge arises from avoiding or minimizing the existence of portions of the latches and/or stops extending into the interior space of the container. Portions extending into the interior increases the likelihood that fruit will be damaged during the packing, shipping and unpacking of the fruit.

Maintaining sufficient flexibility of a container to avoid damage to fruit, achieving integrity of the erected boxes to avoid unintended failures of the latch during shipping and allowing for reliable slap down of a container, presents a designer with many (often diverging) design objectives, particularly when it is desirable to provide the latch in limited space.

An aspect of the invention is directed to a produce container comprising a base and four walls. Each wall is coupled to the base by a corresponding hinge. A first wall of the four walls has a first lateral end and a second lateral end. The first wall is movable on its hinge about a first axis extending in a first direction parallel to the base. The first wall has a latch connected to the wall by a flexible arm at a first location proximate the first lateral end of the first wall. The latch comprises a latch body connected to the flexible arm and resiliently, outwardly movable in a second direction perpendicular to the first direction and parallel to the base when the container is in a substantially erected arrangement. The latch body has an interior surface that is sloped to partially face the second lateral end. The latch also comprises a stop contact having a contact surface perpendicular to the first direction in an unstressed state and resiliently movable about a second axis perpendicular to the first axis and the base, so as to allow the contact surface to partially face the interior when an inward force is applied to the contact surface. The stop contact is connected to the latch body at a second location outward of where a stop contacts the contact surface when in the erected arrangement. A second wall of the four walls is disposed at the first lateral end of the first wall, and is movable on its hinge about a second axis extending in the second direction. The second wall comprises the stop. The stop is rigidly attached to the second wall. The stop is aligned to contact the contact surface as the second wall is rotated about the second axis from the erected arrangement toward the collapsed arrangement and the stop is aligned to contact the interior surface as the second wall is rotated about the second axis from the collapsed arrangement toward the erected arrangement.

In some embodiments, the stop comprises a leading edge positioned to contact the contact surface of a stop contact when the container is in an erected arrangement. In some embodiments, the leading edged comprises a first projection to contact the contact surface, and a second projection extends around the contact surface.

In some embodiments, the container further comprises an interlock formed at the first end, the interlock comprising a first portion on the first wall and a second portion on the second wall, the interlock preventing outward rotation of the first wall and outward rotation of the second wall.

The terms "interior" and "interiorly" refer to interior portion of the container where the container contents are held.

The terms "outward" and "outwardly" means tending in the direction of the outside of the container.

The term "inward" and "inwardly" means tending in the direction of the inside of the container.

References to endwalls and sidewalls herein are merely to facilitate description of selected embodiments of containers, and is not to be limiting. It will be appreciated that the use of the terms endwall or sidewalls is merely for ease of description, and all are appropriately described using the word "wall". In embodiments having sidewalls and endwalls, features of a latch or stop, or other features of a container may be on any suitable wall.

BRIEF DESCRIPTION OF THE SEVERAL VIEWS OF THE DRAWING

The nature and mode of operation of the present invention will now be more fully described in the following detailed description of the invention taken with the accompanying drawing figures, in which.

DETAILED DESCRIPTION OF THE INVENTION

Figure 1A:
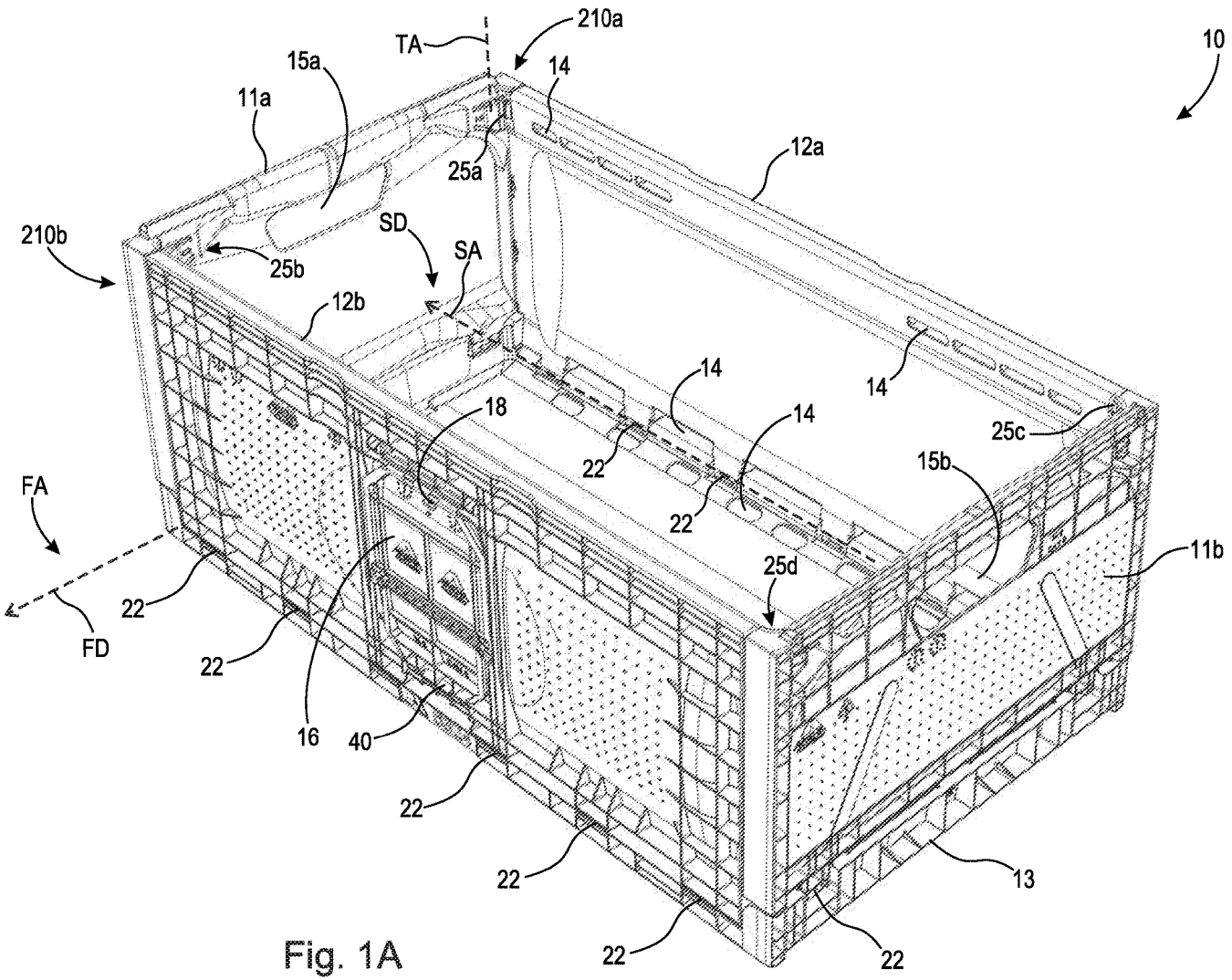
FIGS. 1A and 1B illustrate an embodiment of a container including an example of a latching system according to aspects of the present invention, the container being in an erected configuration and a collapsed configuration, respectively.
Figure 1B:
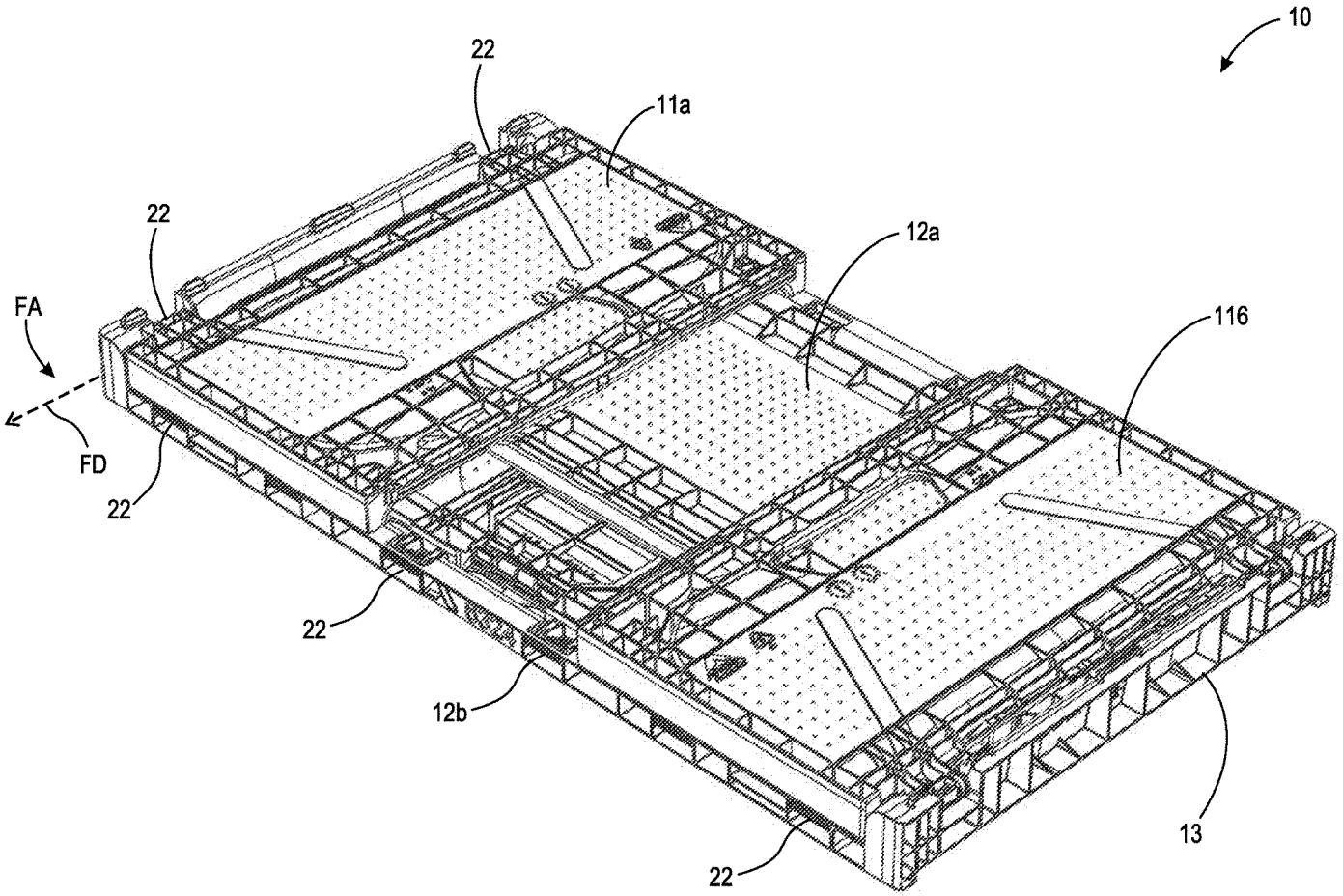

FIGS. 1A and 1B illustrate an embodiment of a container 10 (e.g., an RPC) including an example of a latching system according to aspects of the present invention, the container being in an erected configuration and a collapsed configuration, respectively.

Container 10 includes a base 13 that extends in a horizontal plane, and four walls (illustrated as two endwalls 11*a*, 11*b*, and two sidewalls 12*a*, 12*b*). One of the walls 12*a* includes an opening through which access to the interior of the container is allowed. The opening is covered by an access door 16 when the access door is in a closed position. The access door is coupled to wall 12*a* or base 13 by a hinge 40 to permit opening and closing of door 16. A connector 18 at the top of the door maintains the door in the closed position.

The interior of container 10 is primarily defined by base 13, sidewalls 12 and endwalls 11. Handles 15*a*, 15*b* are located near the top center of each endwall 11. Base 13 and endwalls 11, sidewalls 12 may be flat and smooth monolithic sheets of plastic or be contoured to reduce bruising conditions of the contents of the container.

Because the container is designed to hold produce that may be purposely ripened while in the interior of the container, the container has various ventilation holes 14 along its sidewalls 12 and base 13, which allow for forced air to travel to the produce while packed in the container.

Each wall is coupled to the base by at least one hinge 22. For example, endwall 11*a* is movable on hinges 22 about a first axis FA extending in a first direction FD parallel to base 13, Hinges 22 permit the endwalls 11 and sidewalls 12 to be folded down toward the base 13 to achieve a collapsed configuration (shown in FIG. 1B), and the hinges 22 will permit endwalls 11 and sidewalls 12 to be moved to an upright position to achieve an erected configuration (shown in FIG. 1A).

As described in greater detail below, at each upper corner of the container, the adjacent walls include a latching system 25*a*-25*d* to maintain the walls in the erected configuration, one wall having a latch 200 (shown in FIG. 3A) and the other wall having a stop 500 (shown in FIG. 6A).

Container 10 is typically molded from a plastic material, for example polypropylene. Suitable plastic materials include, but are not limited to, polyethylene, polypropylene, polyvinyl chloride, polyurethane, polyester, epoxy resin, phenolic resin, polystyrene, polycarbonate, combinations thereof and the like. The term "plastic" is used generically herein in its conventional manner and refers to any of the above-listed materials or other similar materials now existing or later developed. Container 10 has a construction that is designed to be strong relative to its weight. The material of the container allows it to be rigid enough to maintain its structural form when erected for storage or transportation, thereby protecting the produce it contains. At the same time, the material of the base 13, endwalls 11, and sidewalls 12 of the container 10 are flexible enough to minimize damage to the contents of the container.

Figure 2:
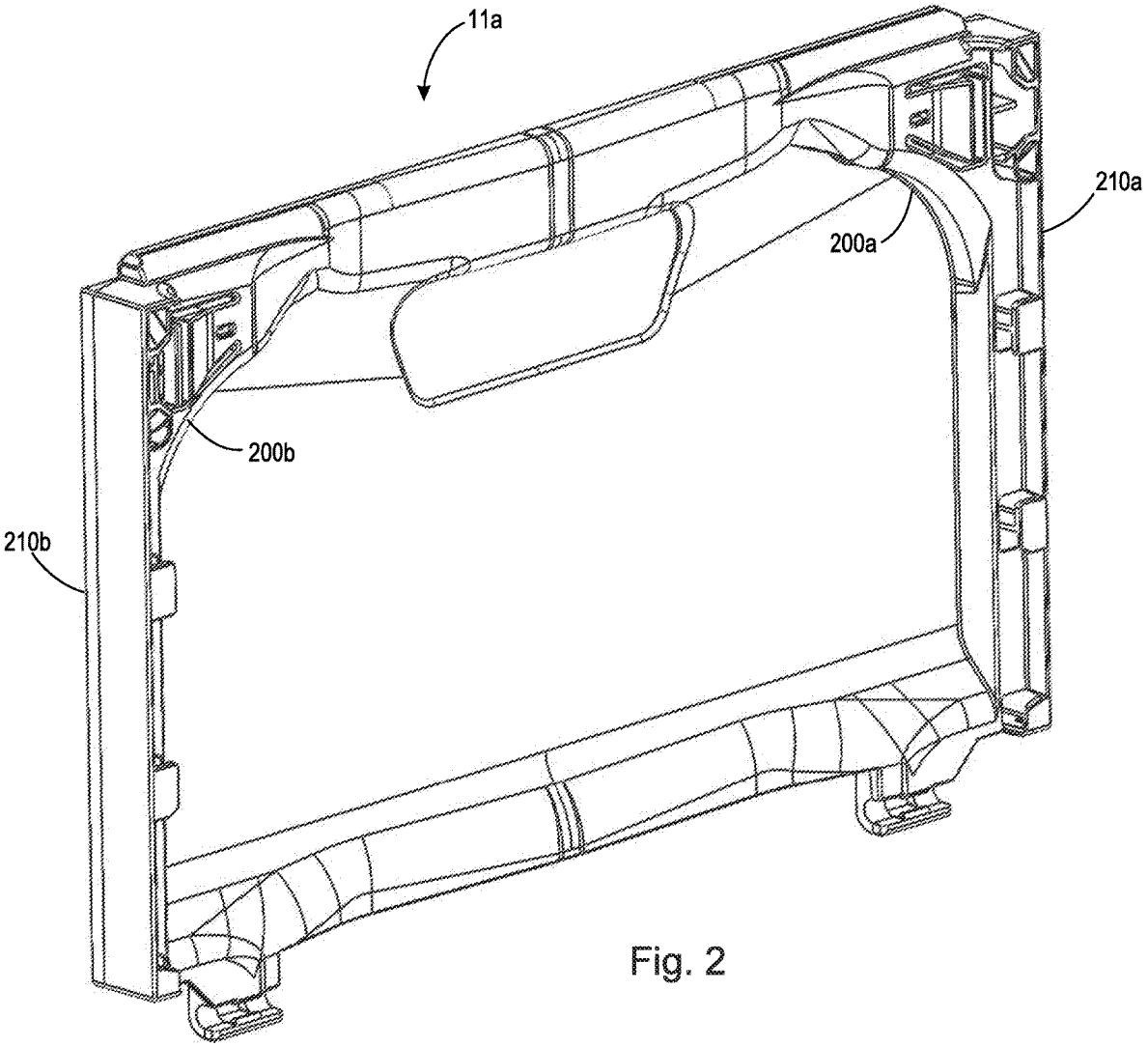
FIG. 2 is a projection view of the endwall of the container of FIG. 1A, the endwall having a latch portion of the latching system.

FIG. 2 is a projection view of endwall 11*a* of the container 10 of FIG. 1A, the endwall having latches 200*a* and 200*b* of latching systems 25*a* and 25*b*, respectively. Each of the latches extend from its respective endwall. Latch 200*a* is disposed proximate a first lateral end 210*a* of endwall 200*a*. Latch 200*b* is disposed proximate a second lateral end 210*b* of endwall 200*a*. Latch system 25*a* (including latch 200*a* and stop 500*a*) will be discussed in detail below. The structure and operation of latch system 25*a* is representative of the latching systems 25*b*-25*d*.

Figure 3A:
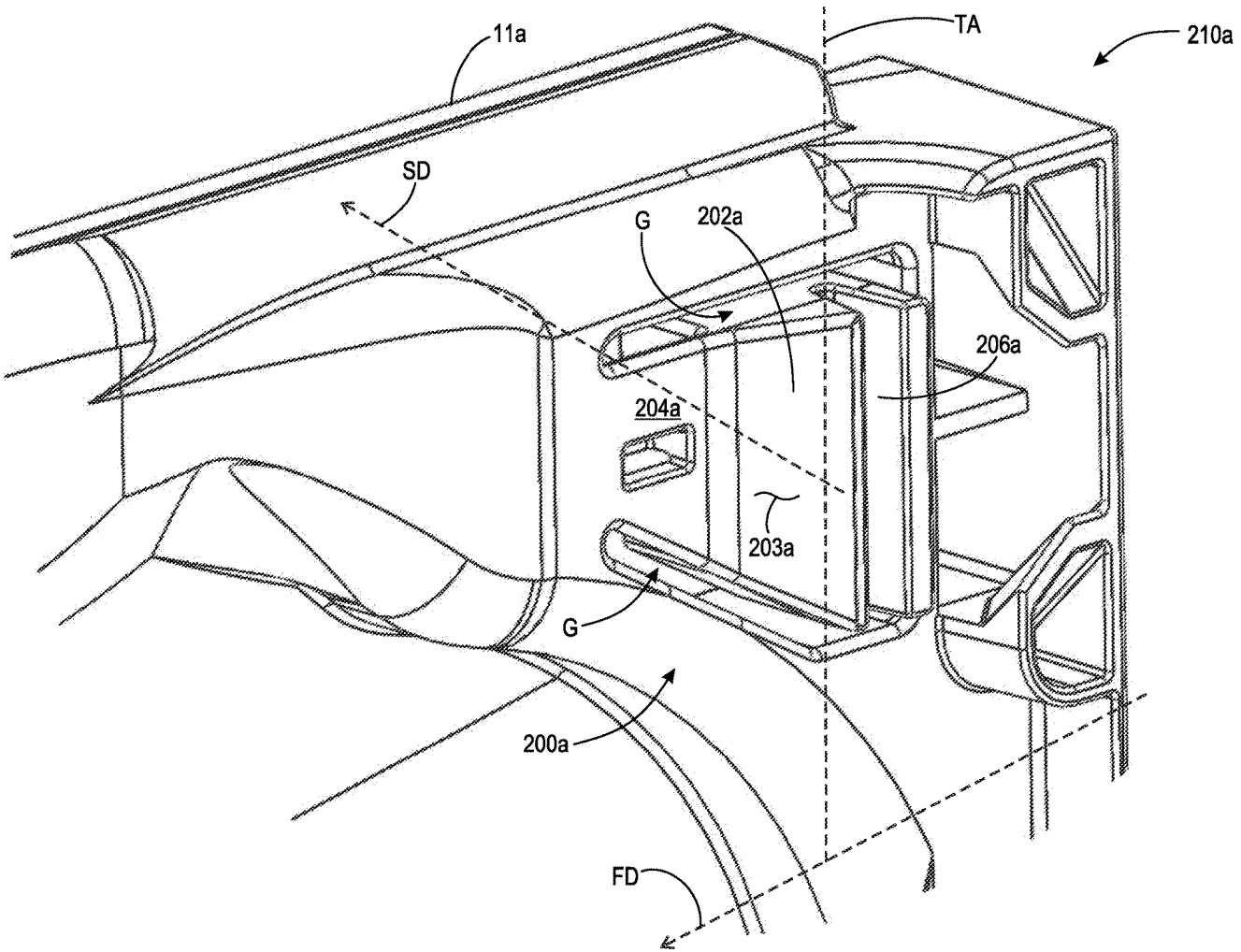
FIGS. 3A-3C are expanded, projection views of a portion of the endwall of FIG. 2 showing further details of the latch.
Figure 3B:
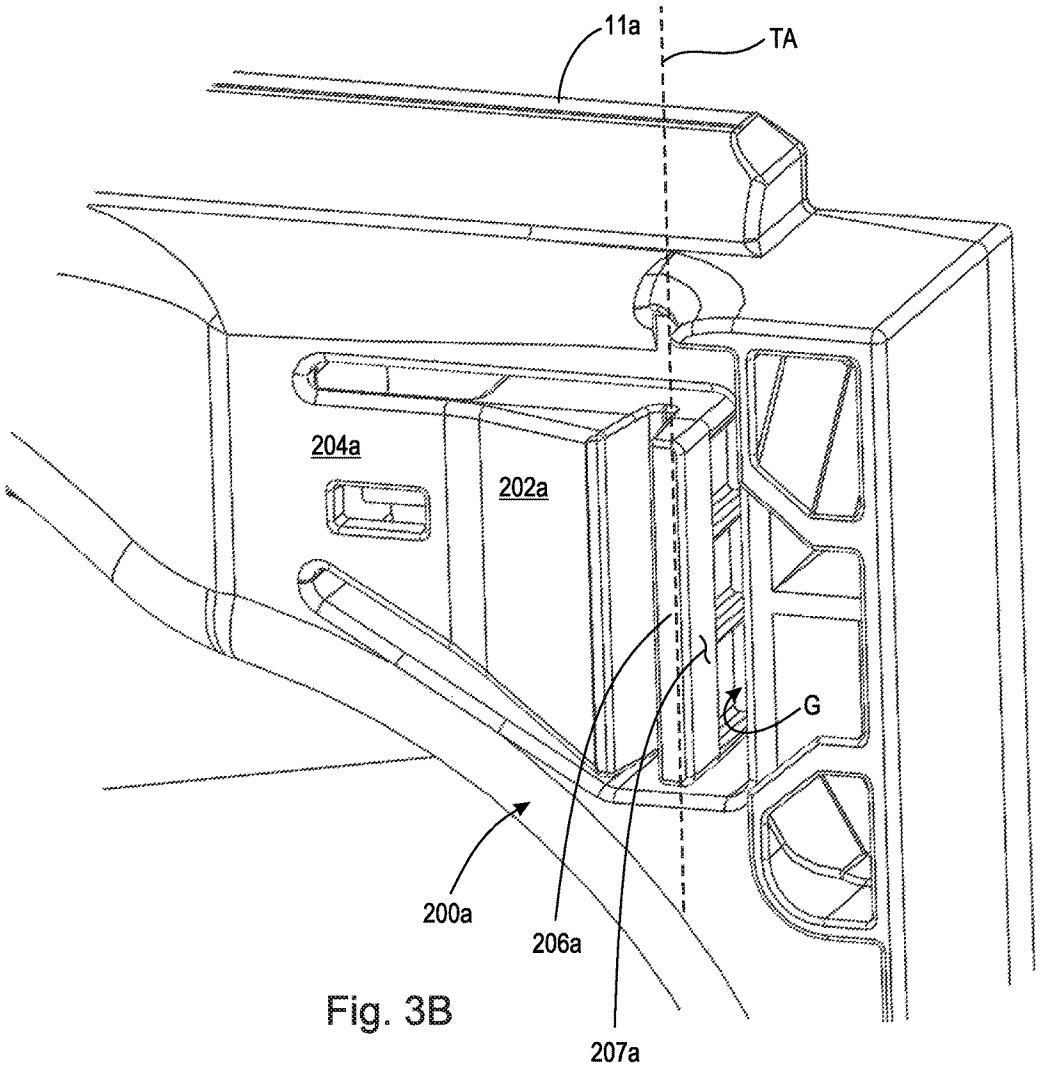
Figure 3C:
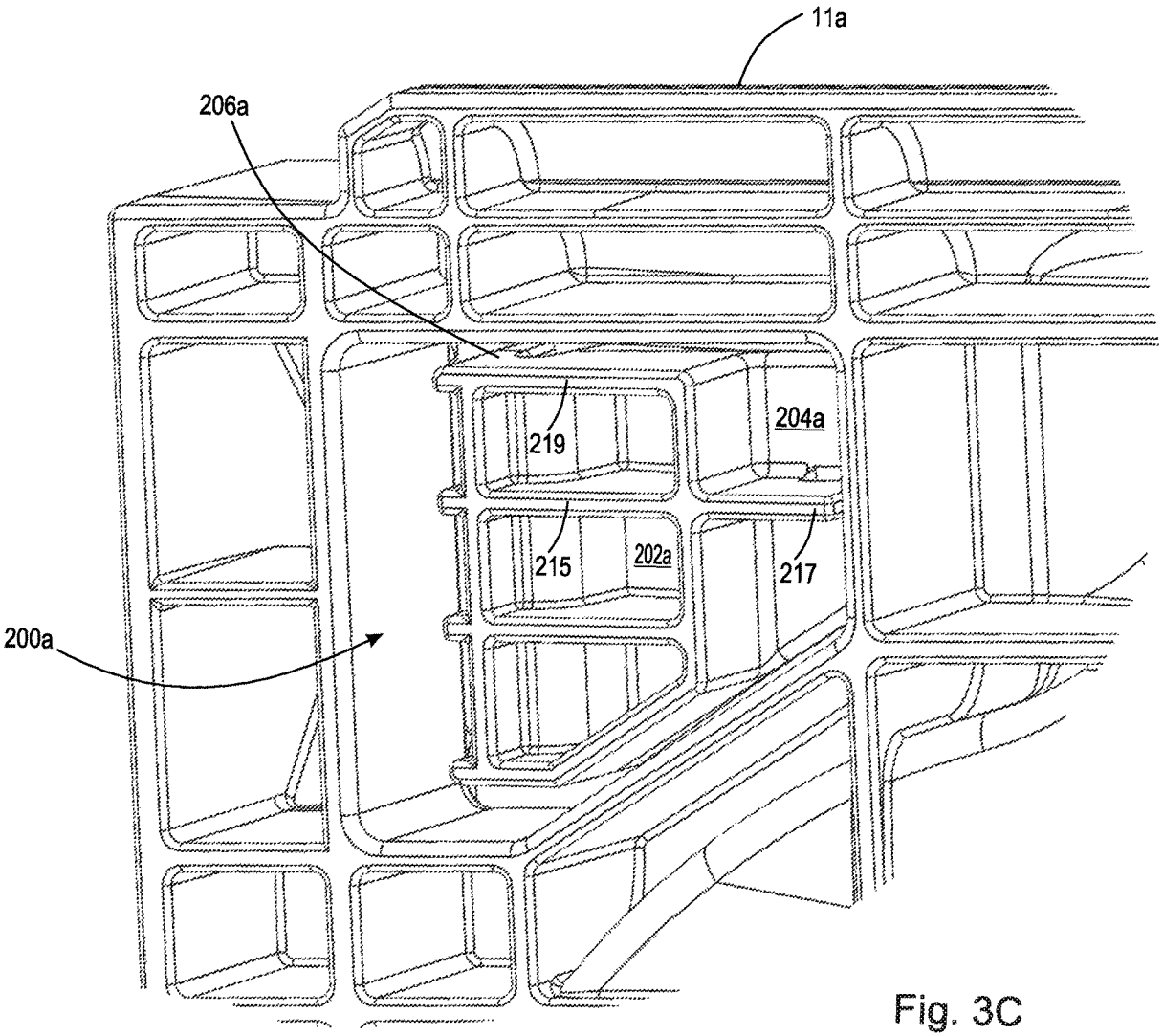

FIGS. 3A-3C are expanded, projection views of a portion of the endwall 11*a* of FIG. 2 showing further details of latch 200*a*. Latch 200*a* comprises a latch body 202*a* connected to the end wall 11*a* by an arm 204*a*, and a stop contact 206*a* connected to latch body 202*a* at a location on the latch body that is opposite arm 204*a*.

Latch body 202*a* is connected to the flexible arm 204*a* so as to be resiliently, outwardly movable in a second direction SD that is perpendicular to the first direction FD (shown in FIG. 1A) and parallel to the base 13 (shown in FIG. 1B) when the container is in a substantially erected arrangement. Latch body 202*a* has an interior surface 203*a* that is sloped to partially face the second lateral end 210*b* (shown in FIG. 2).

Stop contact 206*a* has a contact surface 207*a* at least a portion of which is perpendicular to first direction FD when latch 200*a* is in an unstressed state. Stop contact 206*a* is resiliently movable about a third axis TA that is perpendicular to first axis FA and base 13. The resilient movability allows contact surface 207*a* to face the container interior (shown in FIG. 9) when an inward force is applied to contact surface 207*a*. To facilitate such movement of contact surface 207*a*, stop contact 206*a* is connected to latch body 202*a* at a location outward relative to sidewall 11*a* of where a stop (shown in FIG. 6A) contacts contact surface 207*a* when the container is in the erected arrangement 500*a* (shown in FIG. 1B). The location of connection 211 of stop contact 206*a* to latch body 202*a*, relative to location $L_2$ where stop 500*a* contacts contact surface 207*a* is shown in FIG. 7C. A gap G exists around the latch 200*a* to allow movement of the latch relative to wall 11*a*.

Figure 4A:
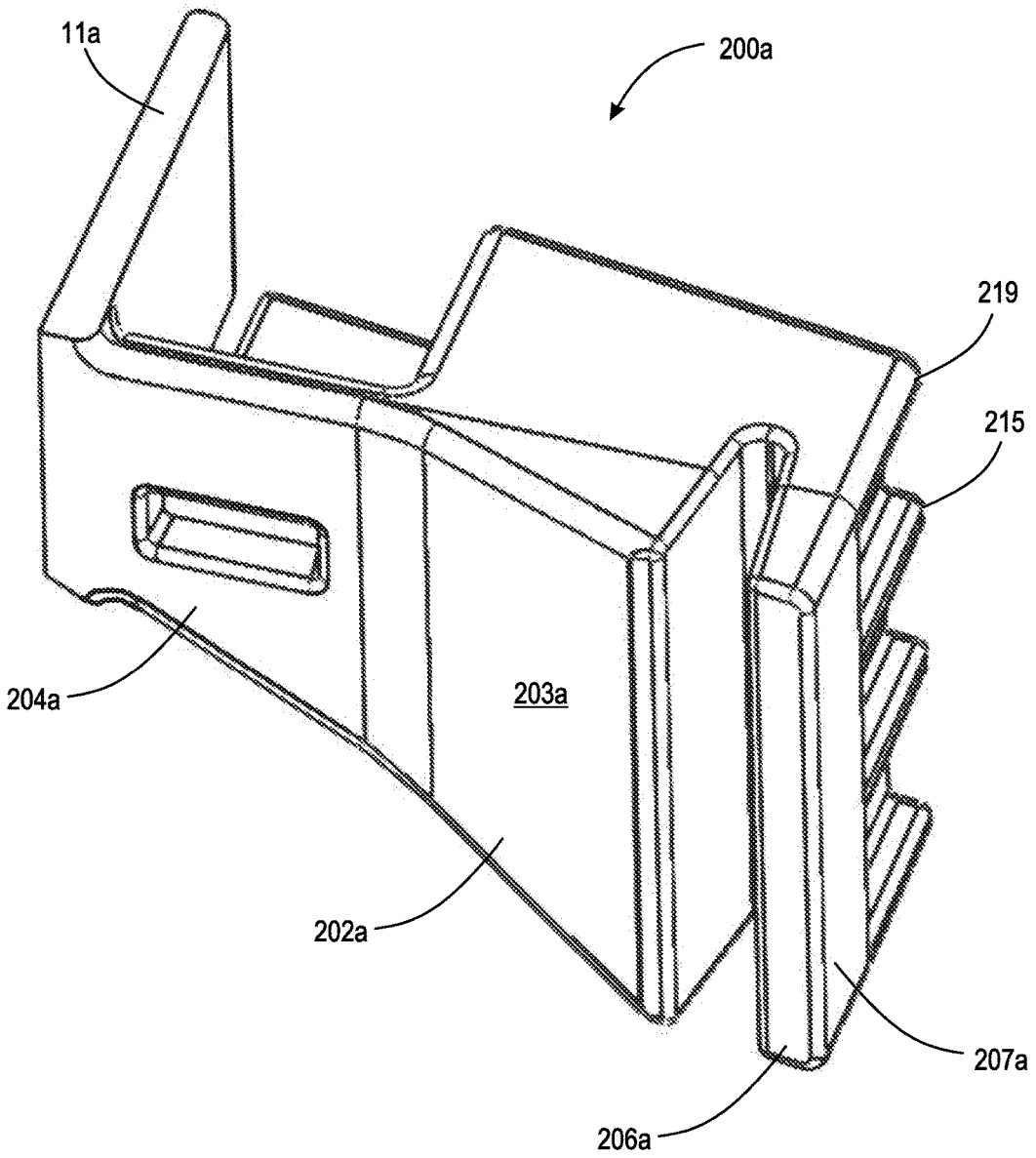
FIGS. 4A-4B are expanded, projection view and a top view of the latch of FIG. 3A-3C.
Figure 4B:
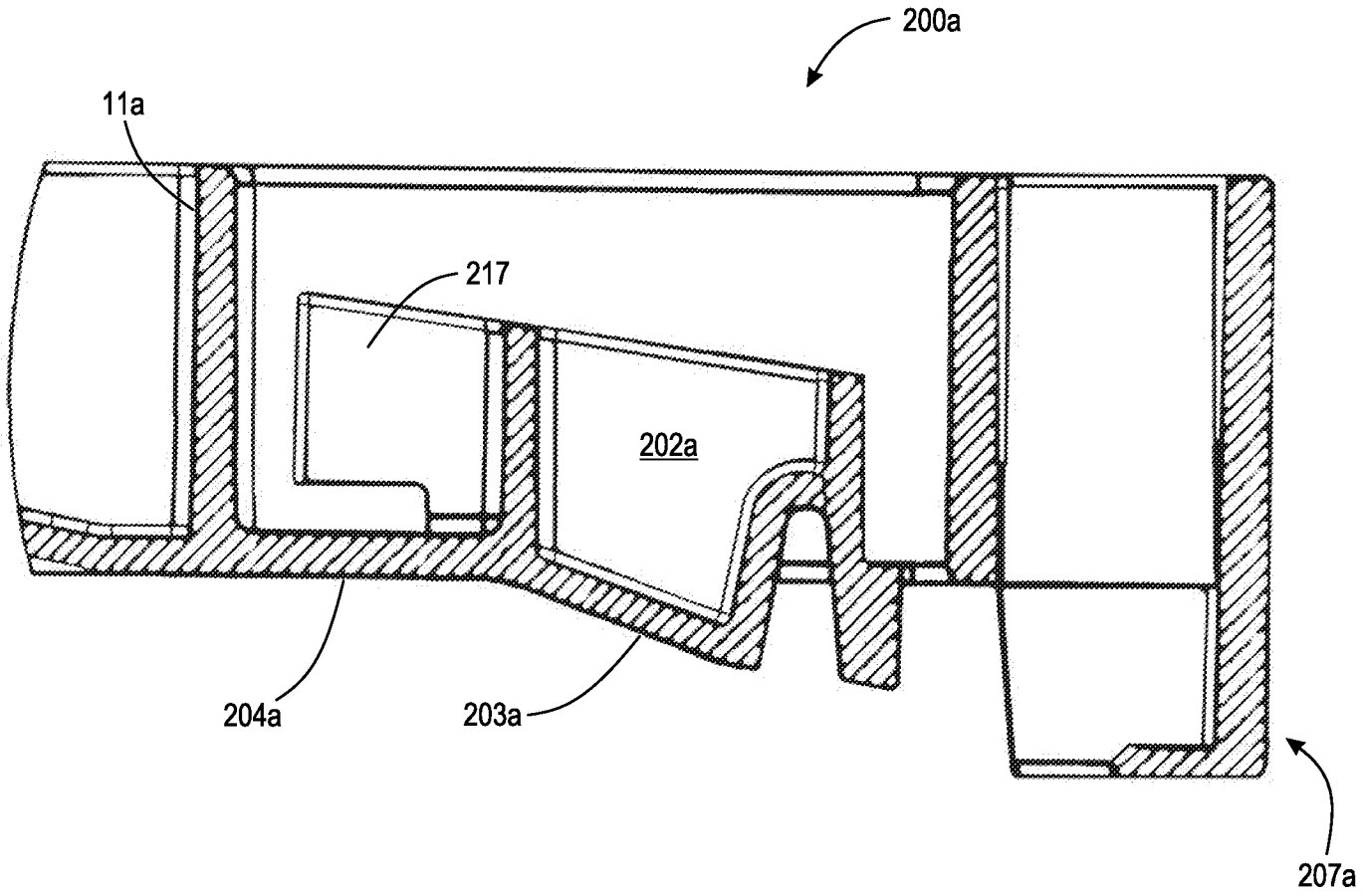

FIG. 4A is an expanded, projection view of latch 200*a* of FIG. 3A and FIG. 4B is a top view of latch 200*a* showing further details of latch 200*a*. All but a portion of wall 11*a* where latch 200 is connected to wall 11*a* have been omitted to avoid obfuscation. Latch rib 217 (also shown in FIG. 3C) is visible.

Figure 5:
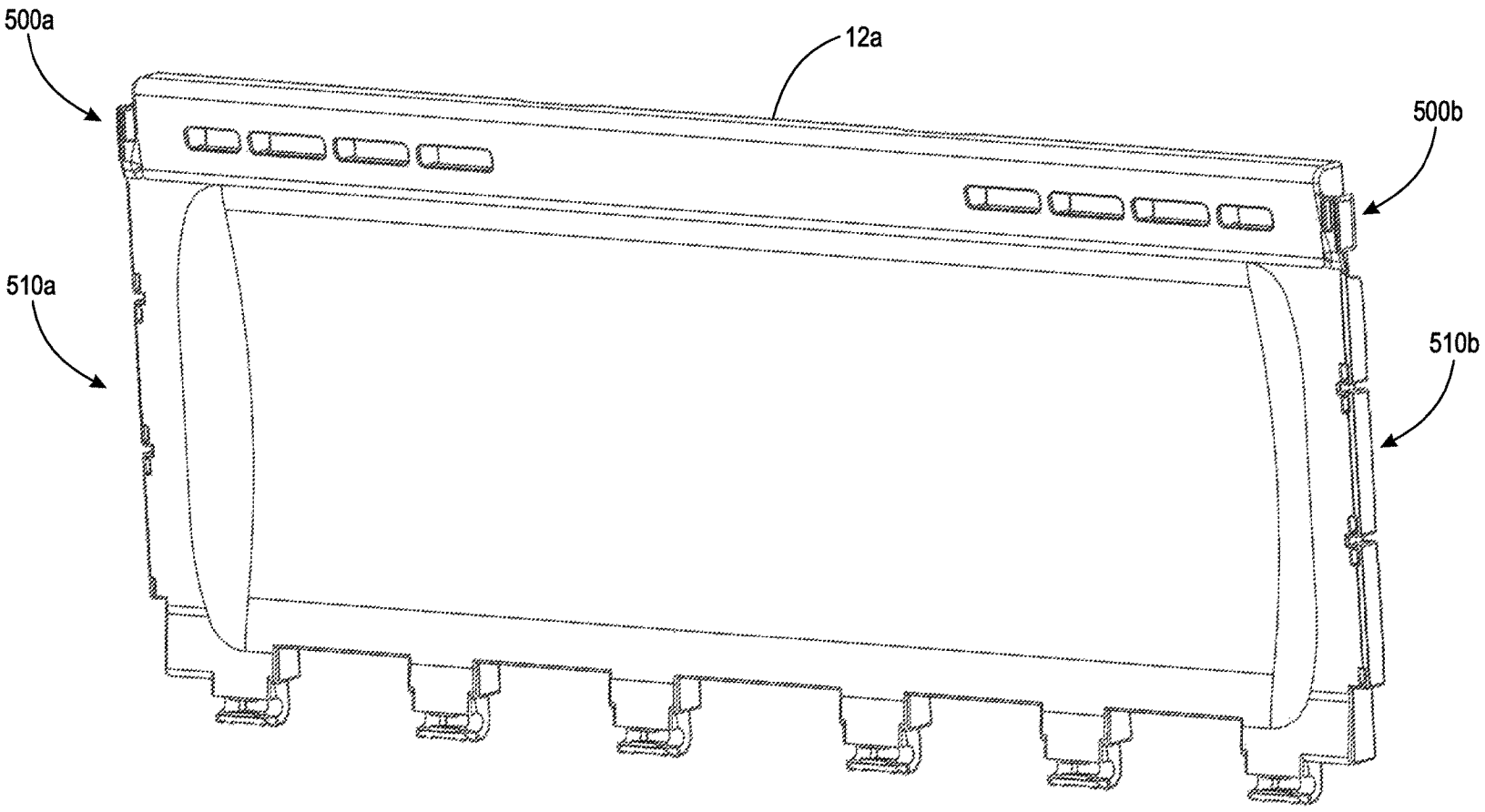
FIG. 5 is a projection view of the sidewall of the container of FIG. 1A, the sidewall comprising a stop portion of the latching system.

FIG. 5 is a projection view of sidewall 12*a* of container 10 shown in FIG. 1A. Sidewall 12*a* comprises a stop 500*a* of latching system 25*a* (shown in FIG. 1A) at first end 510*a*, and a stop 500*b* of latching system 25*b* at second end 510*b*.

Referring to FIG. 1A, in the assembled container in the erected arrangement, sidewall 12*a* is disposed at first lateral end 210*a* of end wall 11*a*. Sidewall 12*a* is movable on second hinge 22 about a second axis SA extending in the second direction SD. Stop 500*a* is rigidly attached to sidewall 12*a*. Stop 500*a* is aligned to contact contact surface 207*a* (shown in FIG. 7C) as sidewall 12*a* is rotated about second axis SA from the erected arrangement toward the collapsed arrangement. Stop 500*a* is also aligned to contact interior surface 203*a* (also referred to herein as an actuation surface; shown in FIG. 7A) as sidewall 12*a* is rotated about second axis SA from the collapsed arrangement toward the erected arrangement.

Figure 6A:
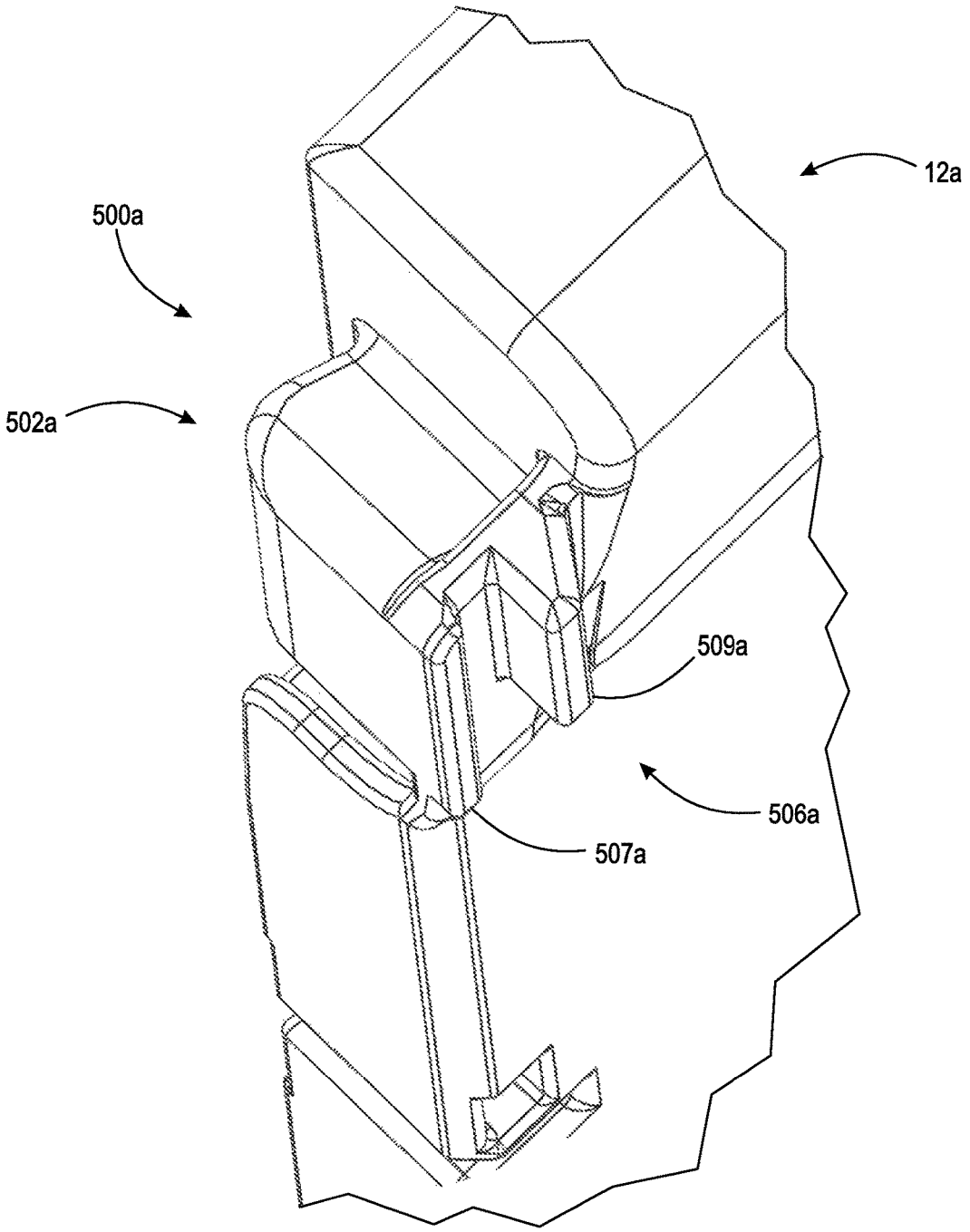
FIGS. 6A-6C are expanded, projection views of a portion of the sidewall of FIG. 5 showing further details of the stop.
Figure 6B:
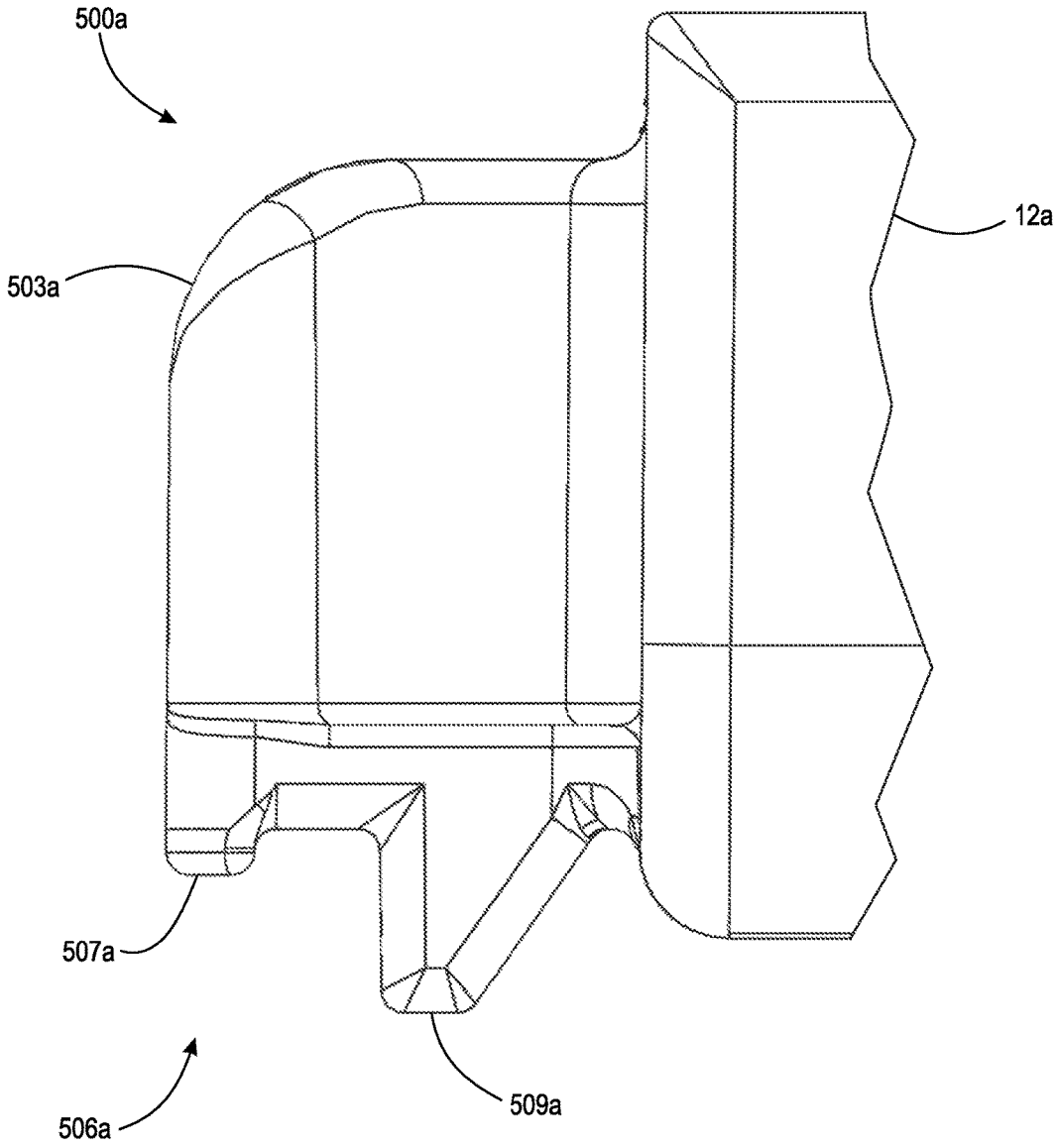
Figure 6C:
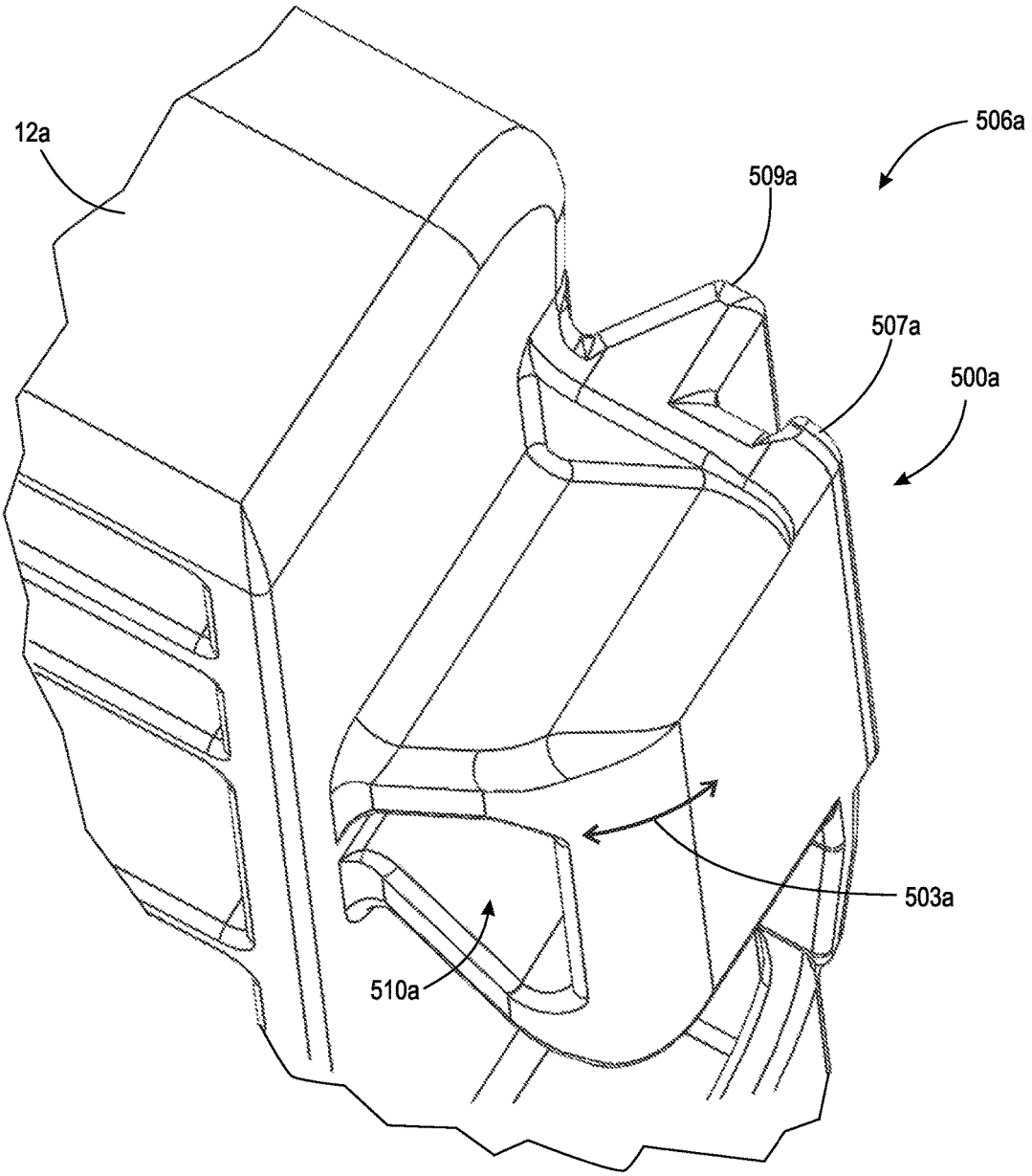

FIGS. 6A-6C are expanded, projection views of a portion of sidewall 12*a* of FIG. 5 showing further details of stop 500*a*. Stop 500*a* has a leading end 502*a*, a portion 503*a* of which engages actuation surface 203*a* of latch body 202*a* as container 10 is moved from a collapsed arrangement to an erected arrangement (shown in FIGS. 7A-7B). The leading edge 502*a* is also shaped to operate as a part of an optional, interlock 1000 (comprised of interlock portion 1000*a* and interlock portion 1000*b*) which is discussed below with reference to FIGS. 10A and 10B. Stop 500*a* also has a trailing edge 506*a* which is shaped to engage contact surface 207*a* of stop contact 206*a* of latch 200*a* when container 10 is an erected arrangement (show in FIG. 7C). A first projection 507*a* is shaped to achieve contact with contact surface 207*a* at a known location $L_2$ (shown in FIG. 7C). As shown in FIG. 7C, in an assembled container in the erected arrangement, second projection 509*a* extends around a side of stop contact 206*a* to further assist in locating first projection 507*a* on contact surface 207*a*. It will be appreciated that, although trailing edge 506*a* is shown with first projection 507*a* and second projection 509*a*, other shapes of the trailing edge may be used, including flat or curved, a single projection or greater than two projections. For example, since stop 500*a* is connected to sidewall 12*a*, other features of sidewall 12*a* and or latch system 25*a* can be used to achieve adequate positioning of contact location $L_2$ between trailing edge 506*a* and contact surface 207*a*.

Various other features of the stop 500*a* may be selected for other purposes. For example, concavity 510*a* in stop 500*a* is present to facilitate molding of the stop.

Figure 7A:
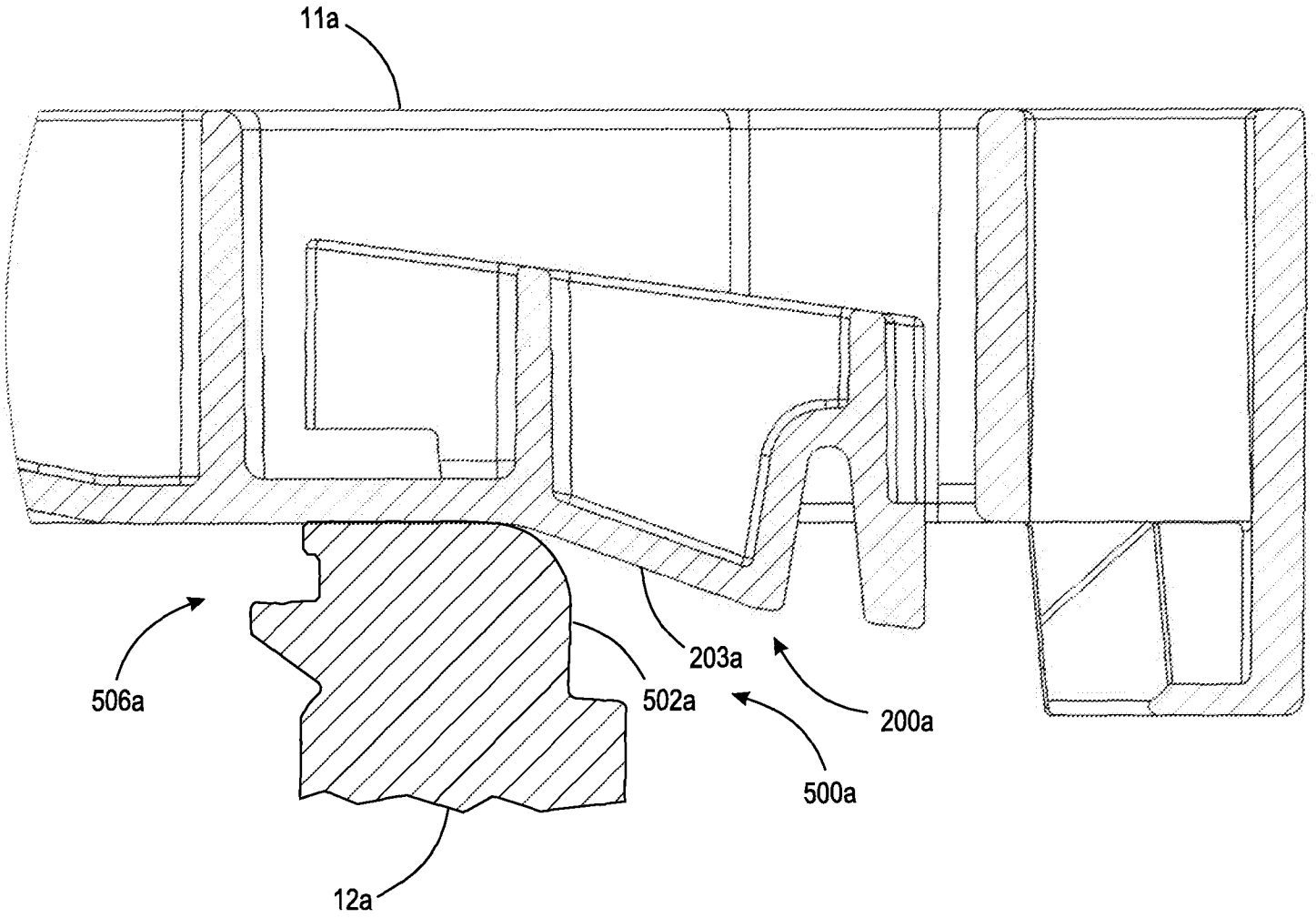
FIGS. 7A-7C are partial, cross-sectional views of the endwall of FIG. 2 and sidewall of FIG. 5 interacting to move from the collapsed arrangement to the erected arrangement of the container of FIGS. 1A and 1B.
Figure 7B:
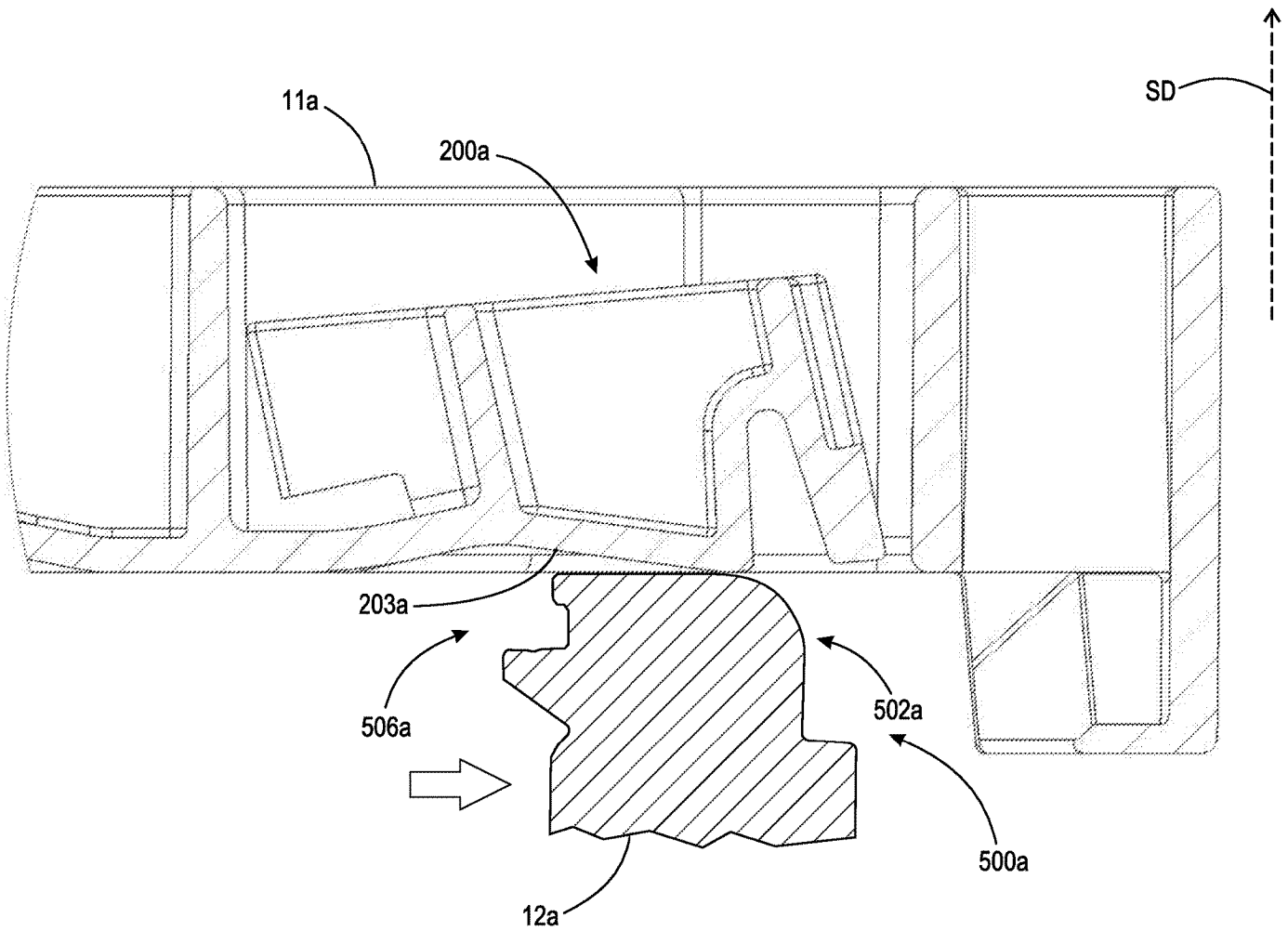
Figure 7C:
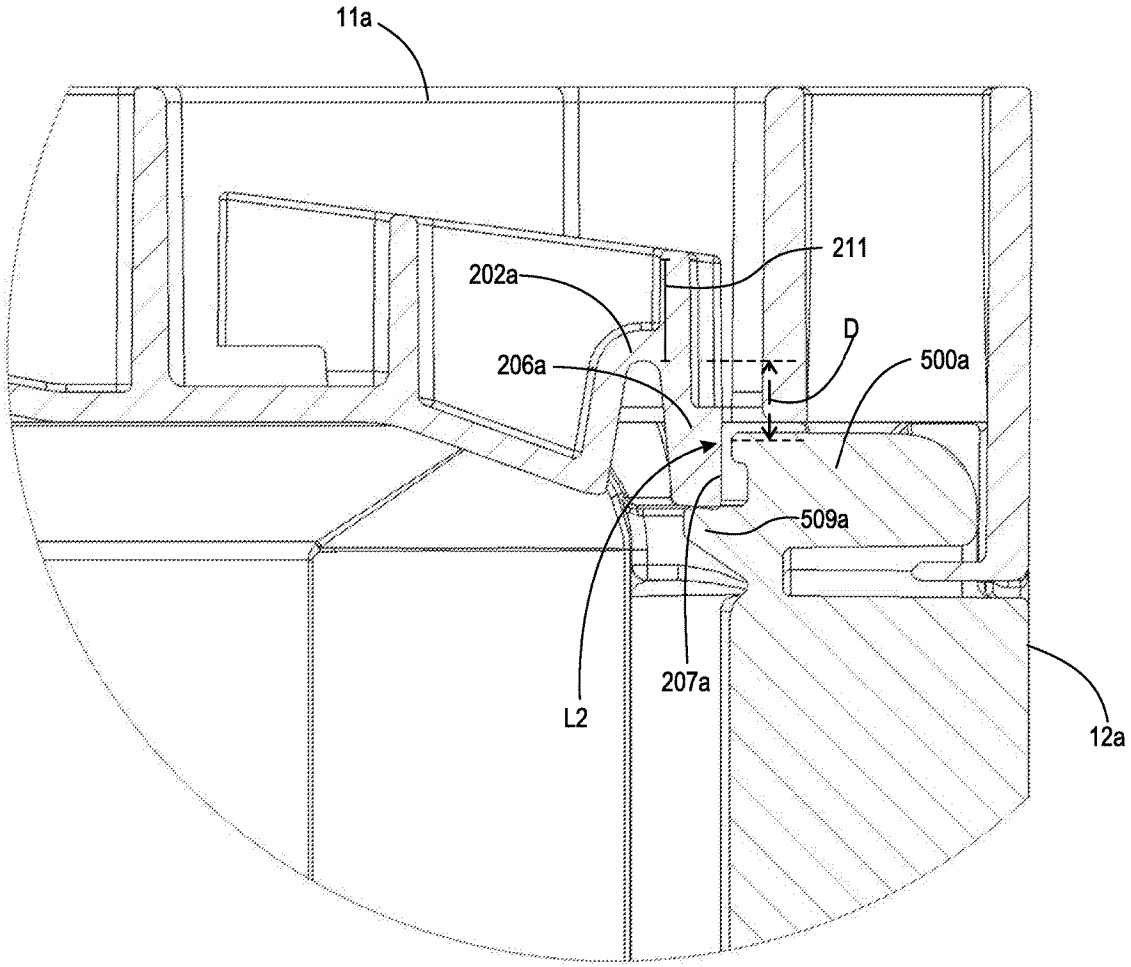

FIGS. 7A-7C are partial downward-looking, cross-sectional views of a portion of endwall 11*a* having a latch 200*a* as shown in FIG. 2 and portion of sidewall 12*a* having a stop 500*a* of FIG. 5. The cross-sections are taken between top rib 219 and rib 215 (shown in FIG. 3C). The latch and stop interact after endwall 11*a* is moved to the erected configuration and sidewall 12*a* is then moved from the collapsed position to the erected position. FIG. 7A illustrates endwall 11*a* in its erected position and sidewall 12*a* in a position partially rotated about its hinge 22 intermediate its collapsed position and its erected position such that stop 500*a* is beginning to contact interior surface 203*a* of latch 200*a*. FIG. 7B illustrates endwall 11*a* in its erected position and sidewall 12*a* in a position more fully rotated about its hinge 22 than shown in FIG. 7A toward its erected position, but still in an intermediate position between its collapsed position and its erected position. In FIG. 7B, stop 500*a* has fully contacted the actuation surface 203*a* of latch 500*a* such that latch 500*a* is moved outwardly in second direction SD allowing passage of sidewall 12*a* to its fully erected position. FIG. 7C shows endwall 11*a* and sidewall 12*a* in their erected positions (i.e., if all other end walls 11*b*-11*d* and sidewalls 12*b*-12*d* are similarly positioned, container 10 is in its erected arrangement).

Figure 8:
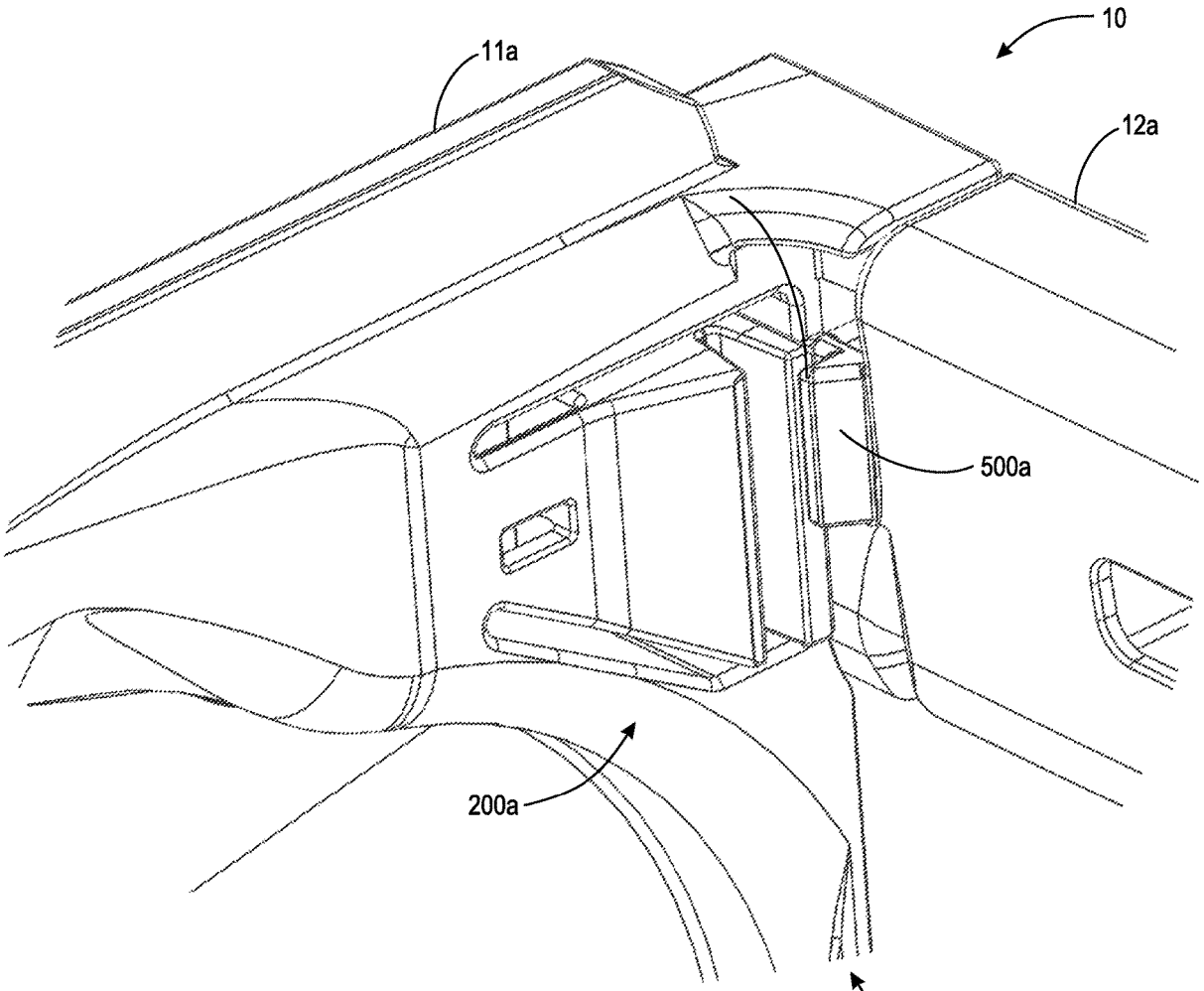
FIG. 8 is an expanded, projection views of a portion of the endwall of FIG. 2 and the sidewall of FIG. 5 showing further details of the latching system.

FIG. 8 is an expanded, projection view of a portion of endwall 11*a* of FIG. 2 and sidewall 12*a* of FIG. 5 showing endwall 11*a* and sidewall 12*a* in their erected positions with latch 500*a* operating to constrain movement of sidewall 12*a* and endwall 11*a*, while configured to facilitate slap down of sidewall 12*a* as described in greater detail below.

Figure 9:
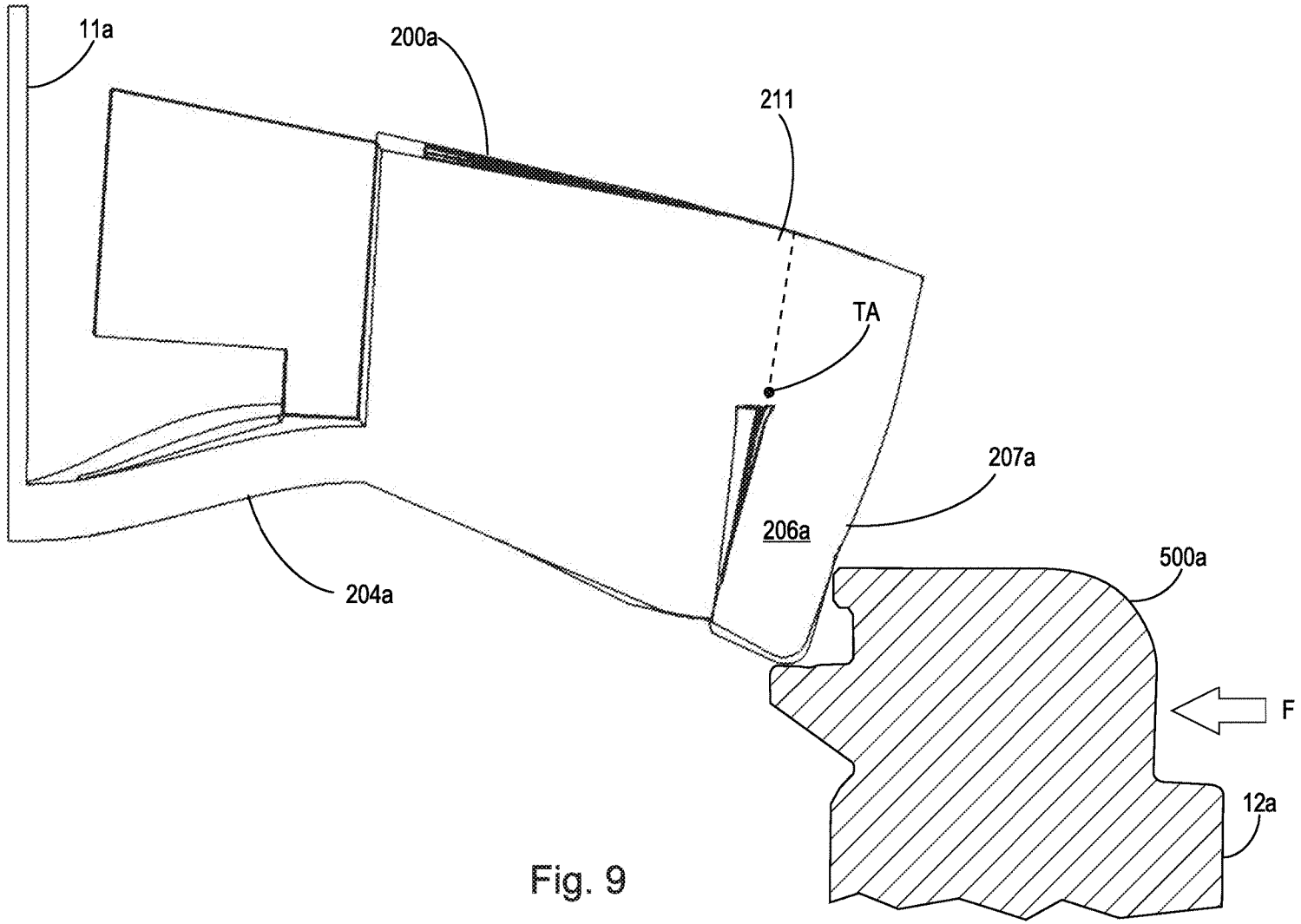
FIG. 9 is an schematic, expanded, cross-sectional view of the endwall and sidewall as shown in FIG. 7C showing deformation of the latch as a result of movement of the stop in response to an inwardly-directed force applied to the sidewall.

FIG. 9 is an expanded, cross-sectional view of endwall 11*a* having a latch 200*a* extending thereform and sidewall 12*a* having a stop 500*a* extending therefrom showing deformation of the latch 200*a* as a result of stop 200*a* in response to an inwardly-directed force F applied to sidewall 12*a*. As illustrated, as a result of bending about connection 211, stop contact 206*a* is rotated about third axis TA such that contact surface 207*a* at least partially faces the container interior. Arm 204*a* may deform (e.g., buckle) further adding to the ability of contact surface 207*a* to rotate about third axis TA to at least partially face in the direction of the interior of the container. Accordingly, the inwardly-directed force F causes stop contact 206*a* to move about third axis TA so as to face the interior of the container 10 and latch 200*a* to move outwardly, thereby allowing sidewall 12*a* to achieve a collapsed position.

It is to be appreciated that latch 500*a* is designed such that deformation of latch 500*a* is a non-plastic deformation such that, after slap down, the resilience of latch 500*a* allows it to re-attain its shape prior to application of the slap down force.

It will also be appreciated that, a configuration of latch 500*a* relying upon deformation (i.e., non-plastic deformation) where a contact surface and a face of a stop are parallel to one another (i.e., the angle between the contact surface and the face of the stop is zero degrees) until a sufficient knock down force is applied, can respond to an external force in a more controllable manner than a latch where the opposing surfaces of the latch which resist the external force are angled relative to one another prior to and during application of the external force as in a latch as described in U.S. Pat. No. 7,059,489. A latch having surfaces angled prior to application of the external force is less reliable since its response to the external force may be influenced by environmental conditions (such as moisture) as well as defacing of the surfaces (e.g., scratching of the surfaces) due to multiple slap down occurrences.

Figure 10A:
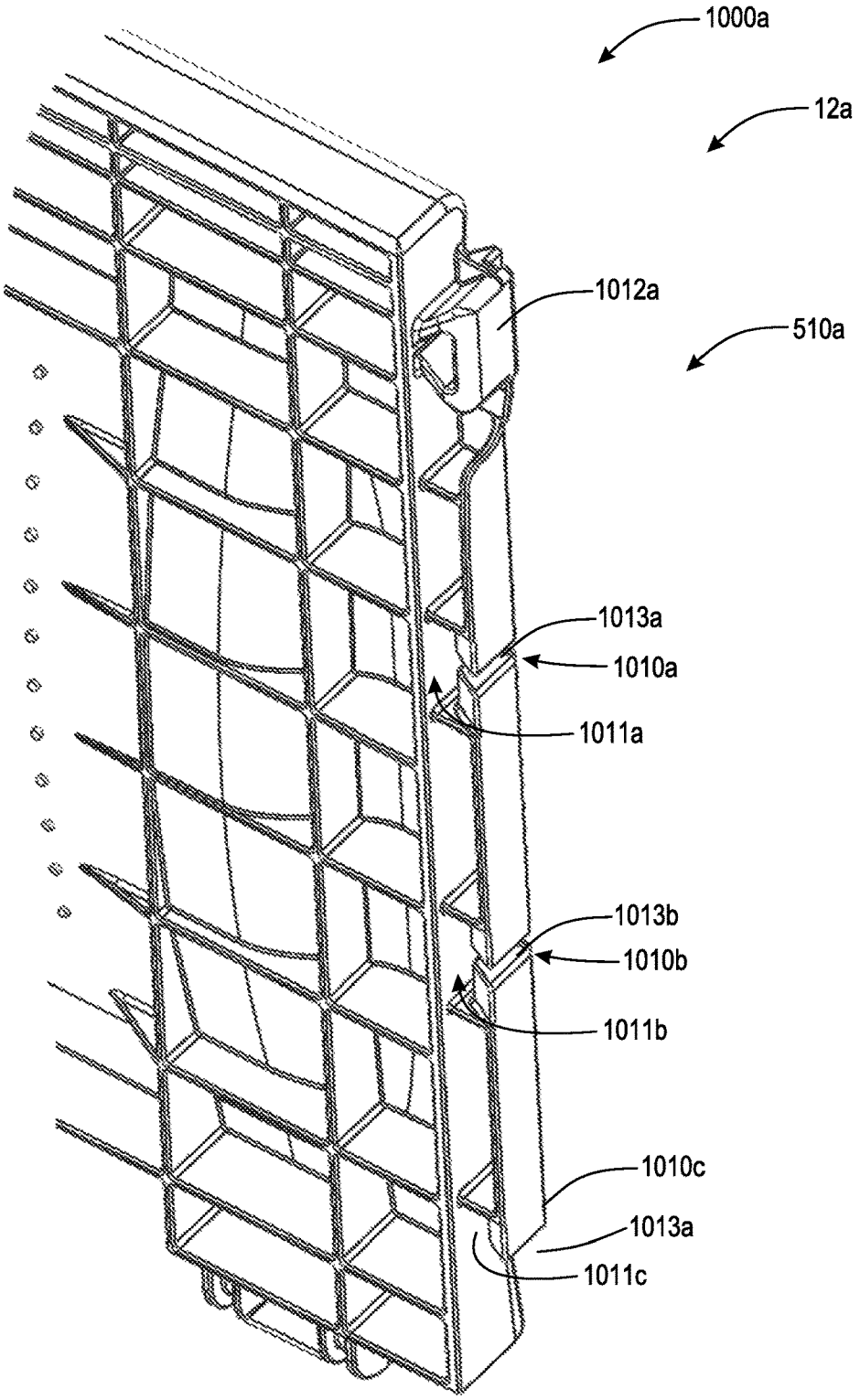
FIGS. 10A and 10B are an expanded, exterior projection view and an expanded plan view of the exterior of an end of a sidewall showing receptacles of an interlock.
Figure 10B:
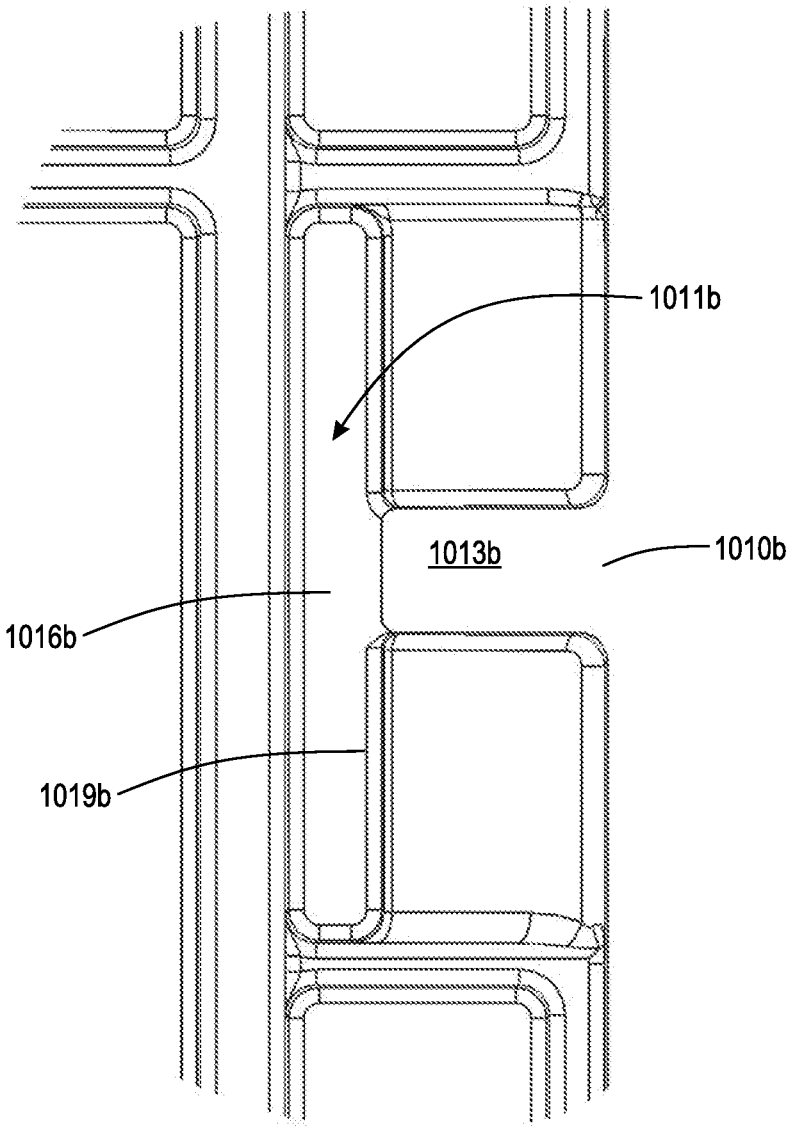
Figure 10C:
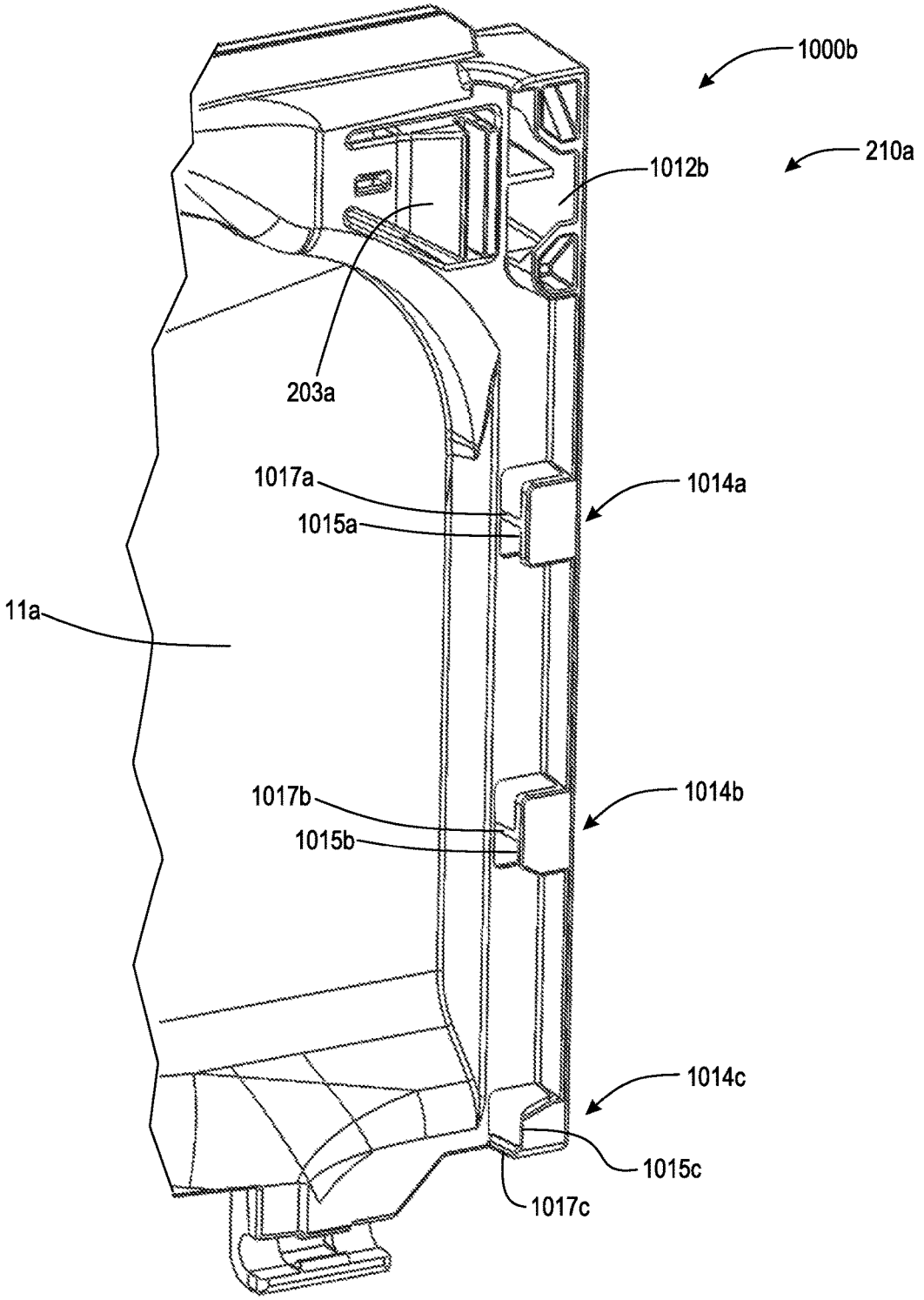
FIG. 10C is an expanded, interior projection view of an end of an endwall showing T-shaped projections of an interlock.

FIGS. 10A and 10B are an expanded, exterior projection view and an expanded plan view of the exterior of first end 510*a* of sidewall 12*a* showing T-shaped receptacles 1010*a*-1010*b* of an interlock portion 1000*a* and a dovetail projection 1012*a* of the interlock portion 1000*a*. Each T-shaped receptacle 1010*a* includes a corresponding vertical opening 1011*a*-1011*b* and a corresponding horizontal opening 1013*a*-1013*b*. FIG. 10C is an expanded, interior projection view of first end 210*a* of endwall 11*a* showing T-shaped projections 1014*a*-1014*b* of interlock portion 1000*b* which enter a corresponding one of receptacles 1010*a*-1010*b*. Each T-shaped projection 1014 includes a corresponding vertical element 1015*a*-1015*b* and a corresponding horizontal element 1017*a*-1017*b*. In addition to the above receptacles and projections, sidewall 12*a* has a partial receptacle 1010*c* (including a partial vertical opening 1011*c* and a space 1017*c* under interlock portion 1000*a*) and endwall 11*a* has a partial T-shaped projection 1014*c* (including a partial vertical element 1015*c* and a horizontal element 1017*c*). Endwall 11*a* includes a receptacle 1012*b* shaped to receive dovetail projection 1012*a* of sidewall 12*a*. As discussed below, interlock portion 1000*a* and interlock portion 1000*b* interact in a conventional manner (with each receptacle being able to receive a corresponding projection with little room for movement therein) to form an interlock for providing stability to walls 11*a* and 12*a*. Although interlock 1000 is shown with three interlocking receptacles and projections each being T-shaped or partial T-shaped or dovetail-shaped, other shapes and quantities of interlocking features can be used.

It will be appreciated that container 10, latch system 25*a* as described above prevents inward rotation of the sidewall 12*a* about hinges 22. Inward rotation of the endwall 11*a* is prevented by the presence of sidewall 12*a*; in particular, endwall 11*a* is prevented from rotating inwardly by the presence of first end 510*a* of sidewall 12*a*. As shown for example in FIG. 7C, inward rotation of endwall 11*a* is prevented by sidewall 12*a* contacting various features of sidewall 12*a* at the cross-section shown in FIG. 7C as well as features at other cross-sectional heights parallel to the cross-section in FIG. 7C. The purpose of interlock 1000 is to prevent excessive outward rotation of endwall 11*a* and sidewall 12*a* beyond their erected positions.

It will be appreciated that for embodiments having an interlock as shown in FIGS. 10A and 10B, once the T-projections 1014 are received into receptacles 1010, with each vertical wall 1017 fitting into its corresponding vertical slot 1011 and each horizontal wall 1015 fitting into its corresponding horizontal slot 1013, outward rotation of sidewall is prevented by the interface of each T-projection 104 with the bottom of its corresponding receptacle (only bottom 1016*b* is illustrated (shown in FIG. 10B)), and outward rotation of endwall 11*a* is prevented by the interface of T-projections 1014 with respective sidewalls 1019 of vertical openings 1011. It is to be appreciated that an interlock as shown is merely one example of a structure suitable for preventing excessive outward rotation of endwalls 11 and sidewalls 12 of a container including a latching system as described herein. For example, a cable or rope (not shown) of an appropriate length may be connected between base 13 and an upper portion of an endwall 11 and/or sidewall 12 such that, when the wall is in a fully-upright position, the tension of the cable or rope keeps the wall from rotating excessively (i.e., beyond the erected position). Alternatively, a flexible cable or rope can be replaced by multiple rigid sections of material (e.g., metal or plastic) (not shown) connected together by a hinge (not shown) to operate to prevent the wall from excessive outward rotation (i.e., beyond the erected position) as in a conventional suitcase or briefcase.

In embodiments having an interlock as shown in FIGS. 10A and 10B, it is to be appreciated that, with endwall 11*a* in an erected position, as sidewall 12*a* is rotated toward an erected position, receptacles 1010*a*-1010*c* engage T-projection 1014*a*-1014*c* in an order from bottom 1010*c*, 1014*c* to top 1010*a*, 1014*a*. However, as stop 500*a* engages actuation surface 203*a*, endwall 11 may be flexed outwardly as a result of interaction between stop 500*a* and actuation surface 203*a* (shown in FIGS. 7A and 7B). Accordingly, receptacle 1012*b* of dovetail projection 1012*a* may extend in an inward direction beyond the latch (i.e., opposite second direction SD; as shown in FIG. 3A) such that the dovetail projection 1012*a* and an inward end of the receptacle 1012*b*. Upon engagement of the taper of the dovetail projection 1012*a* engages the taper of the receptacle 1012*b*, endwall 11*a* and sidewall 12*a* are drawn together to their final, fully-engaged position.

Figure 11A:
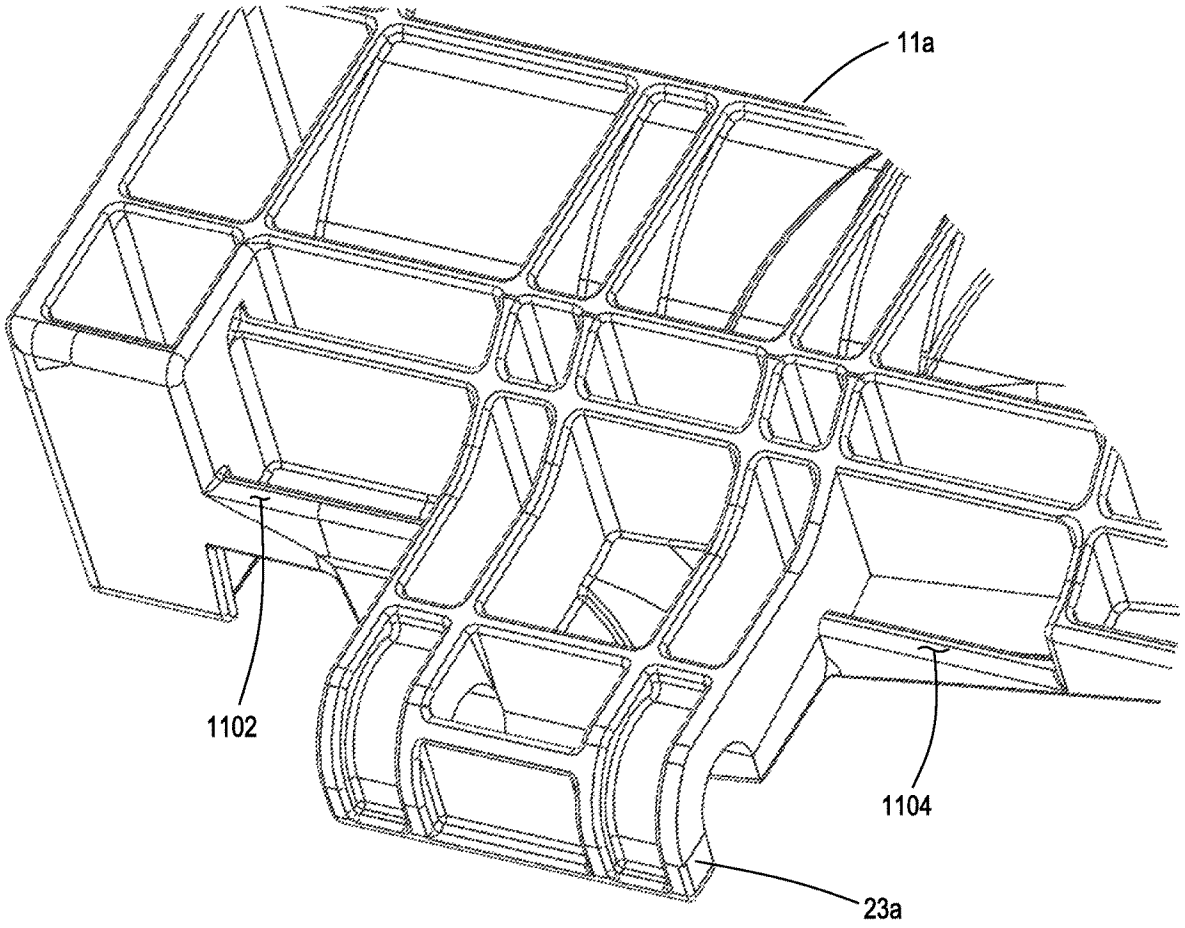
FIGS. 11A-11B are expanded projection views showing details of clamp, hinge components of the endwall and sidewall, respectfully.
Figure 11B:
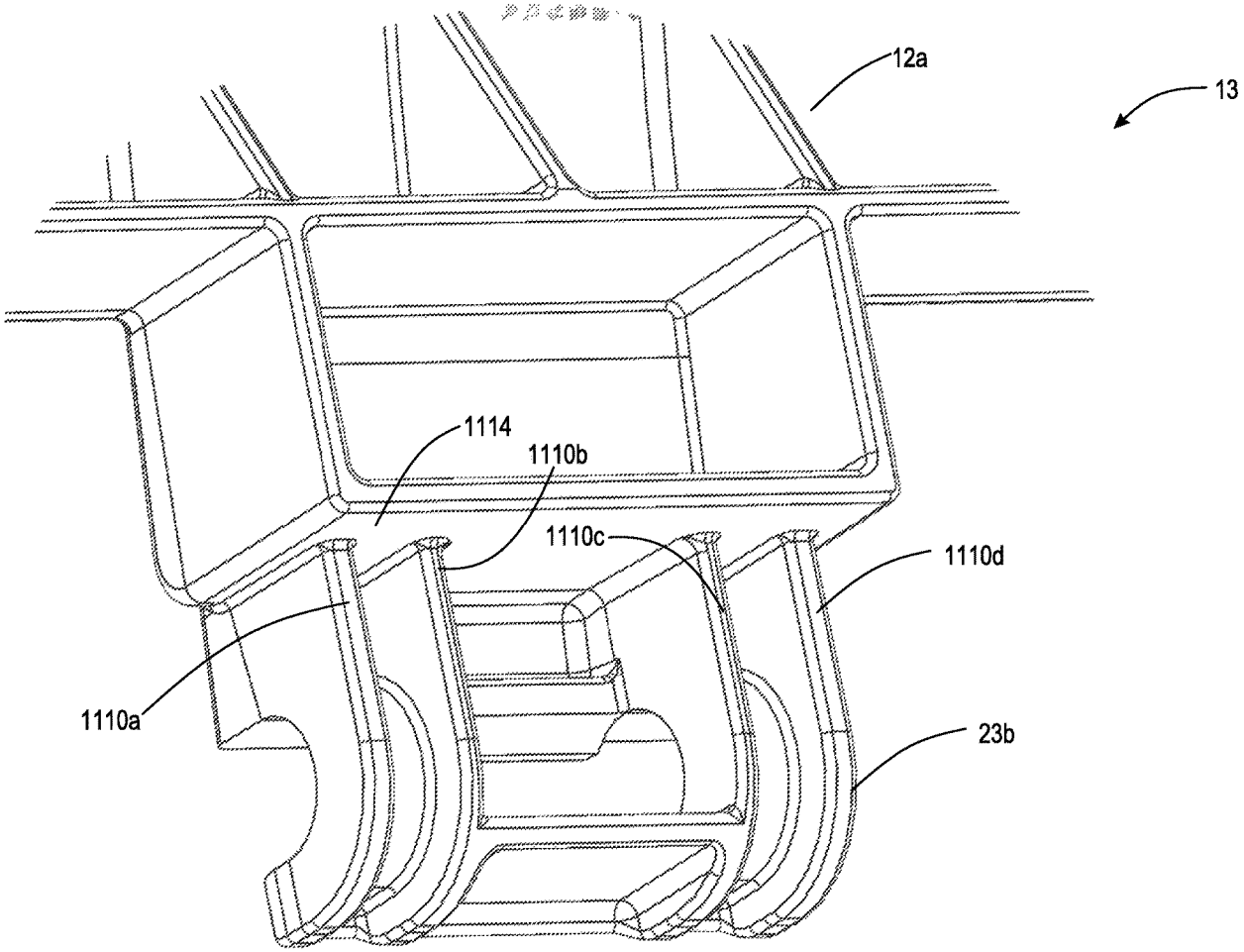
Figure 11C:
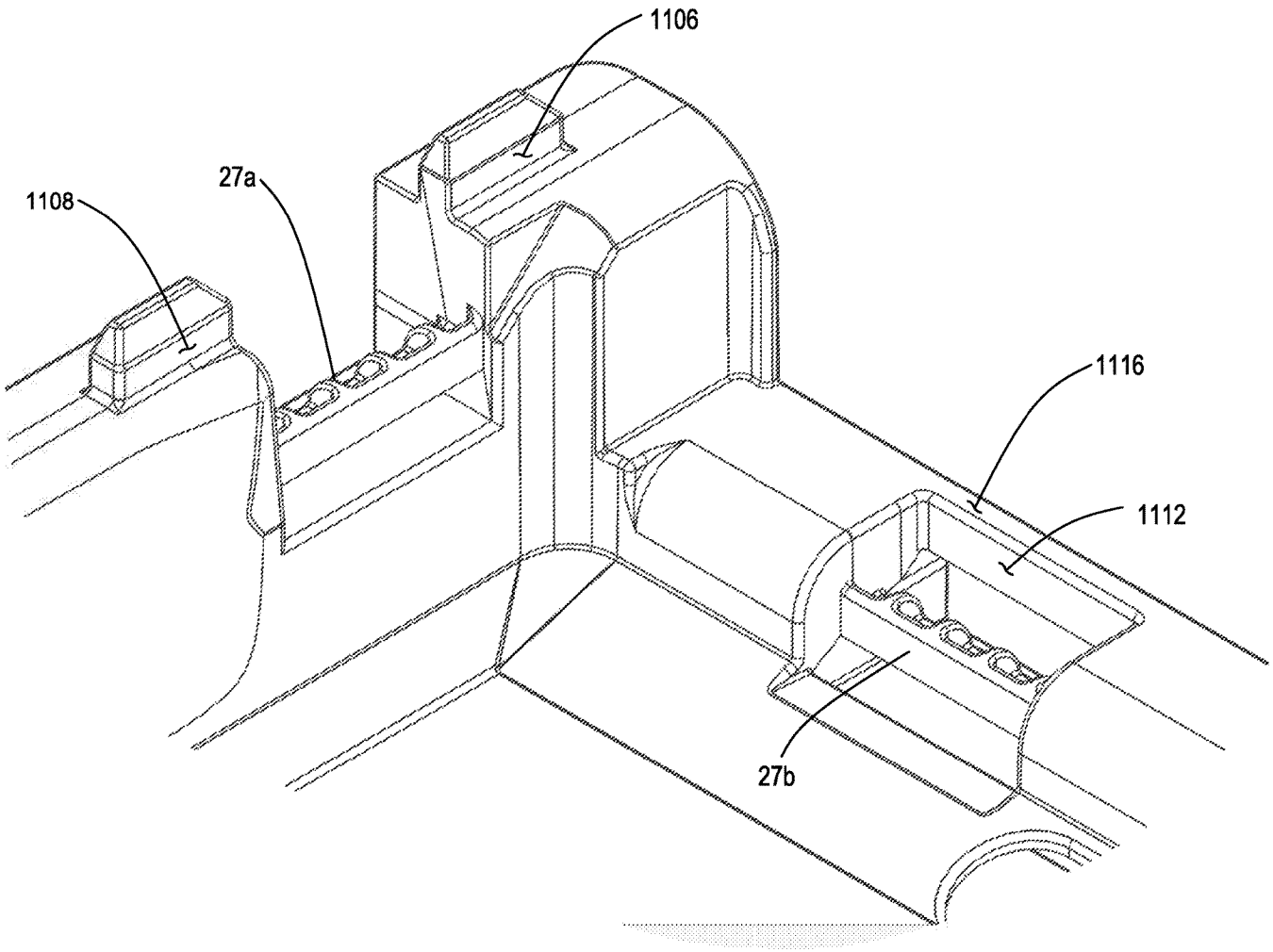
FIG. 11C are expanded projection views showing details of bar, hinge components of the base for receiving endwall and sidewall clamps of FIGS. 11A and 11B, respectfully.

FIGS. 11A-11B are expanded projection views showing details of clamp 23*a*, 23*b*, hinge components of the endwall 11*a* and sidewall 12*a*, respectfully. FIG. 11C are expanded projection views showing details of bars 27*a* and 27*b*, hinge components of base 13 for engaging endwall clamp 23*a* and sidewall clamps 23*b* of FIGS. 11A and 11B, respectively. In particular, aspects of hinges 22 (formed by components 23*a* and 27*a*, and components 23*b* and 27*b*) that are suitable for preventing over-rotation of the endwalls 11 and/or sidewalls 12 are discussed below. In some embodiments, hinges of appropriate design may be used instead of or in addition to an interlock (e.g., interlock 1000), cable, rope or hinged rigid sections as described above. Alternatively hinges may be used in addition to other features to prevent excessive outward rotation (i.e., past the erected position). In the embodiment shown in FIGS. 11A-11C, clamp 23*b* on sidewall 12*a* is attached to bar 27*b* on base 13, and clamp 23*a* on endwall 11 is attached to bar 27*a* on base 13. Excessive outward rotation of endwall is prevented by walls 1102 and 1104 on endwall hinge component 23*a* contacting walls 1106 and 1108 on base 13, respectively. Excessive outward rotation of sidewall 12*a* is prevented by walls 1110*a*-1110*d* on endwall, hinge component 23*b* contacting wall 1112 on base 13, and wall 1114 on sidewall 12*a* contacting wall 1116 on base 13.

In the embodiments described above, latching systems 25*a*-25*d* (shown in FIG. 1A) were described for use in a container; however, it is to be appreciated that latches as described herein may be used in other apparatus. For example, the latch configurations as described herein may also be used in any application where a rotation of a wall (e.g., a door) is to be prevented in a first rotational direction until a force greater than a selected magnitude is applied, and rotation in a second rotational direction (opposite the first rotational direction) is permitted (i.e., apparatus or features to prevent rotation in the second rotation directions is not present or is controlled in another manner).

Figure 12A:
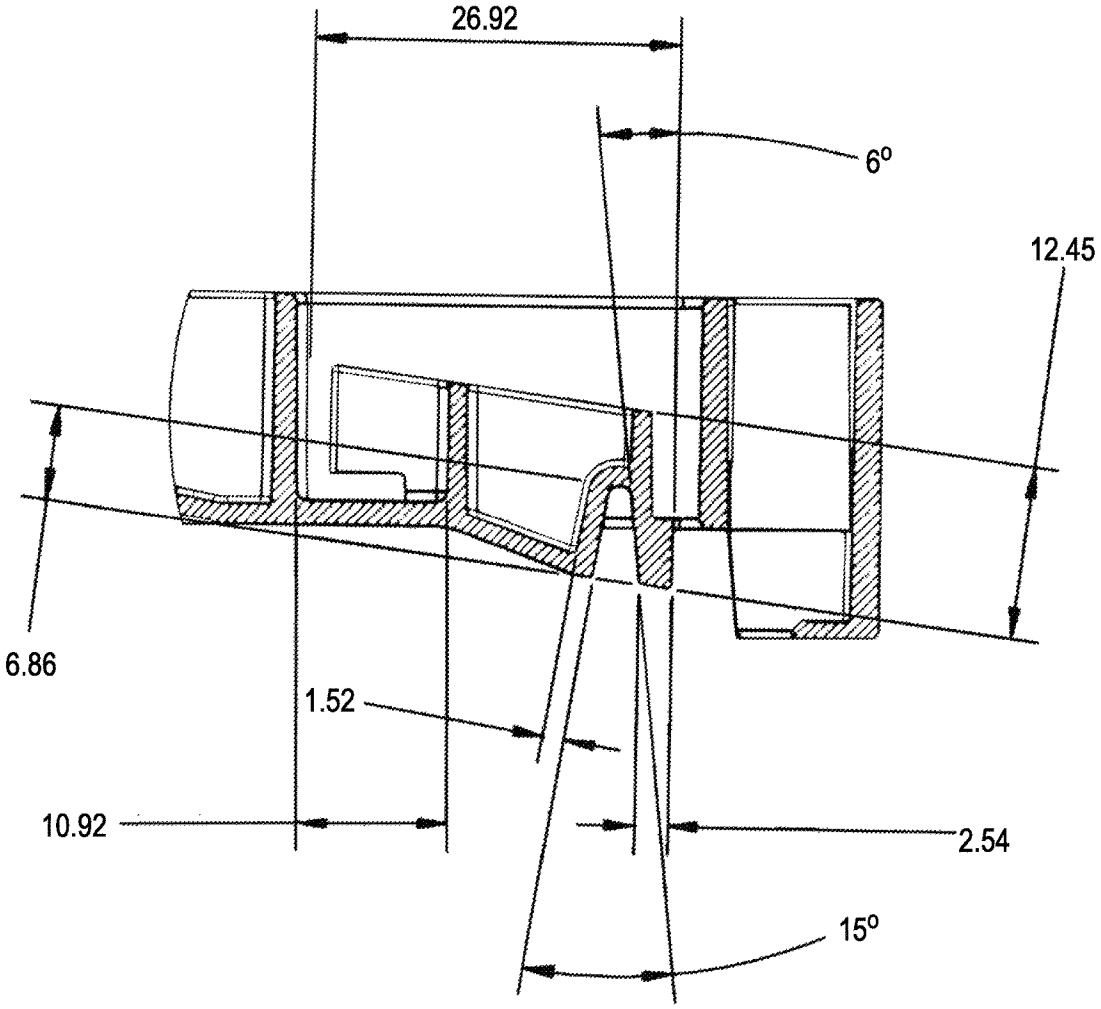
FIGS. 12A-12E show dimensions of one example of an embodiment of a latching system in a container according to aspects of the invention.
Figure 12B:
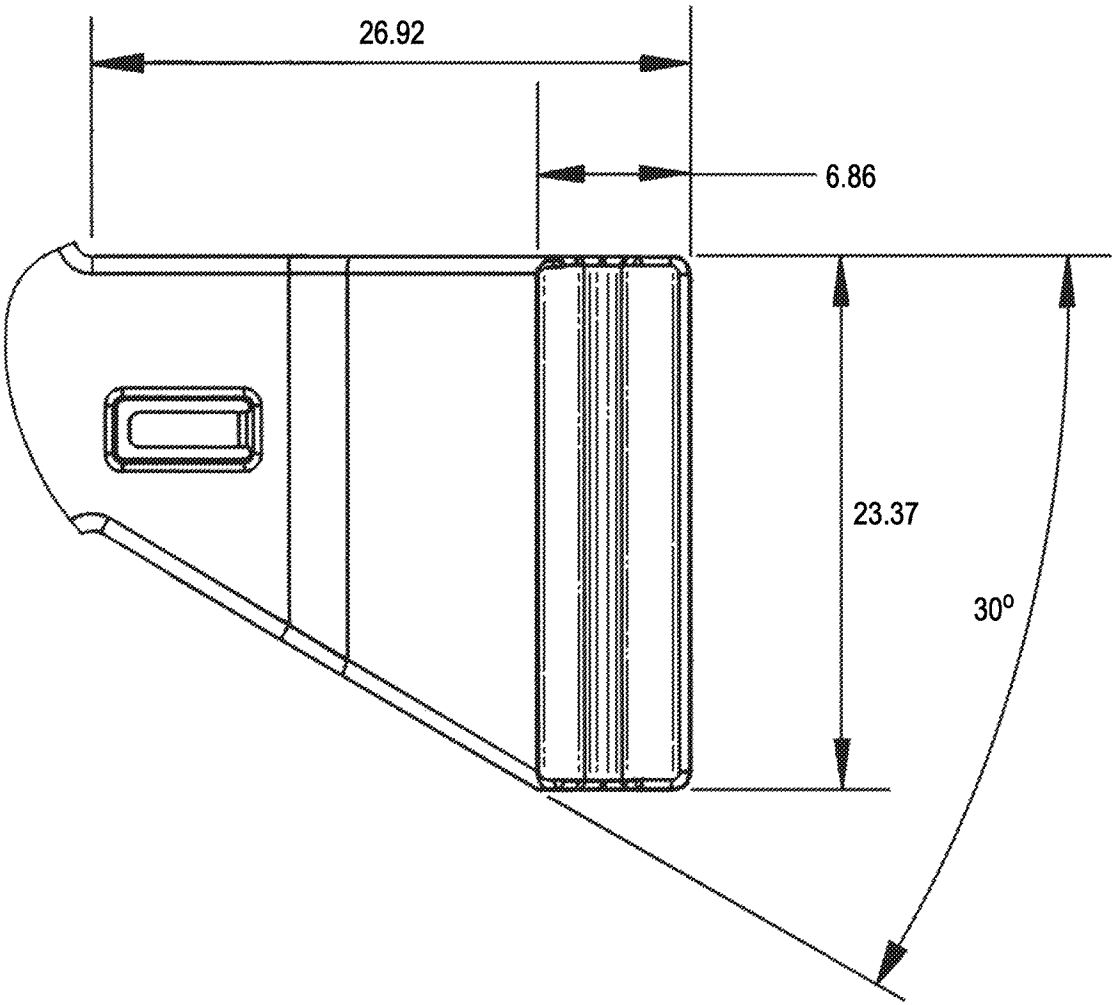
Figure 12C:
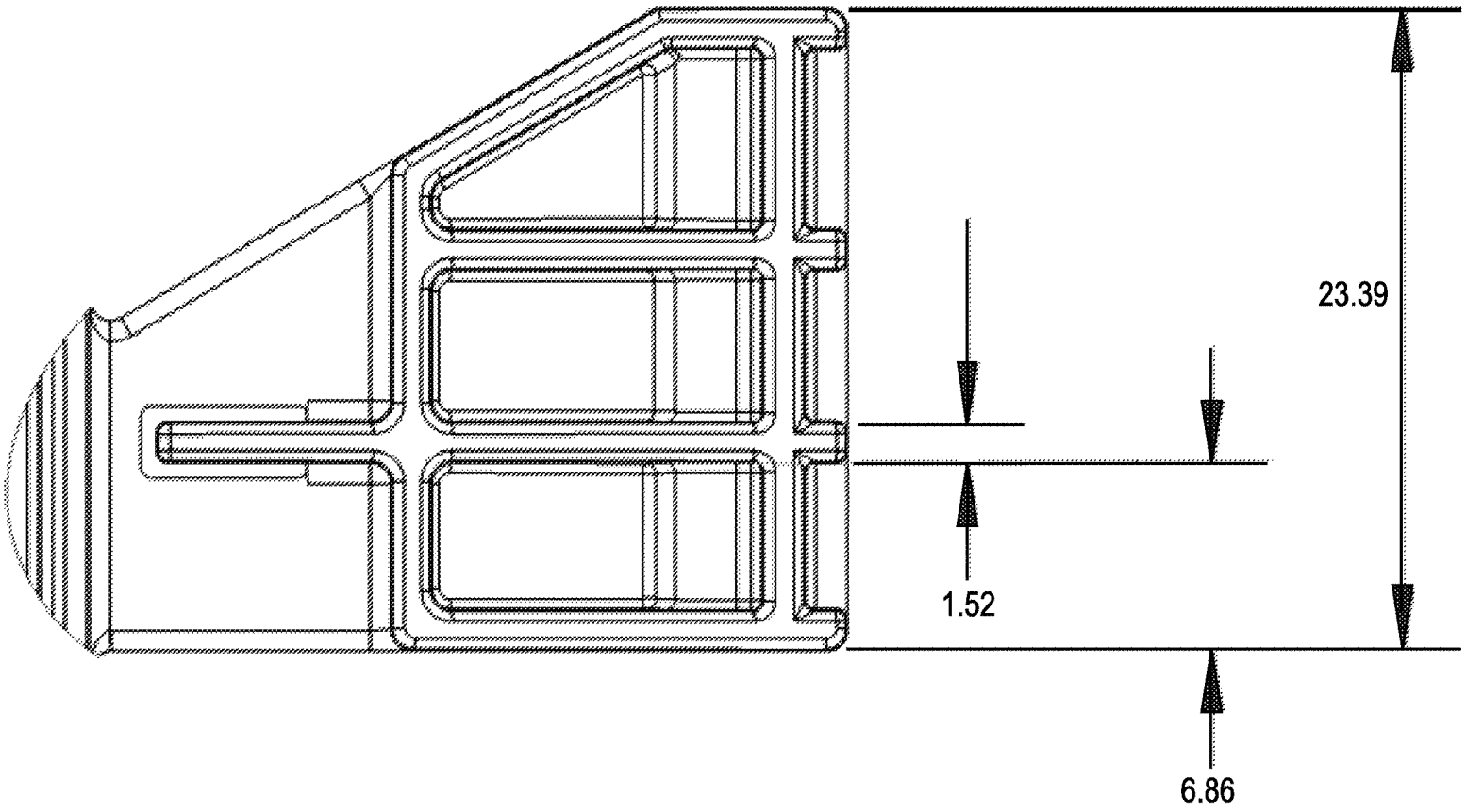
Figure 12D:
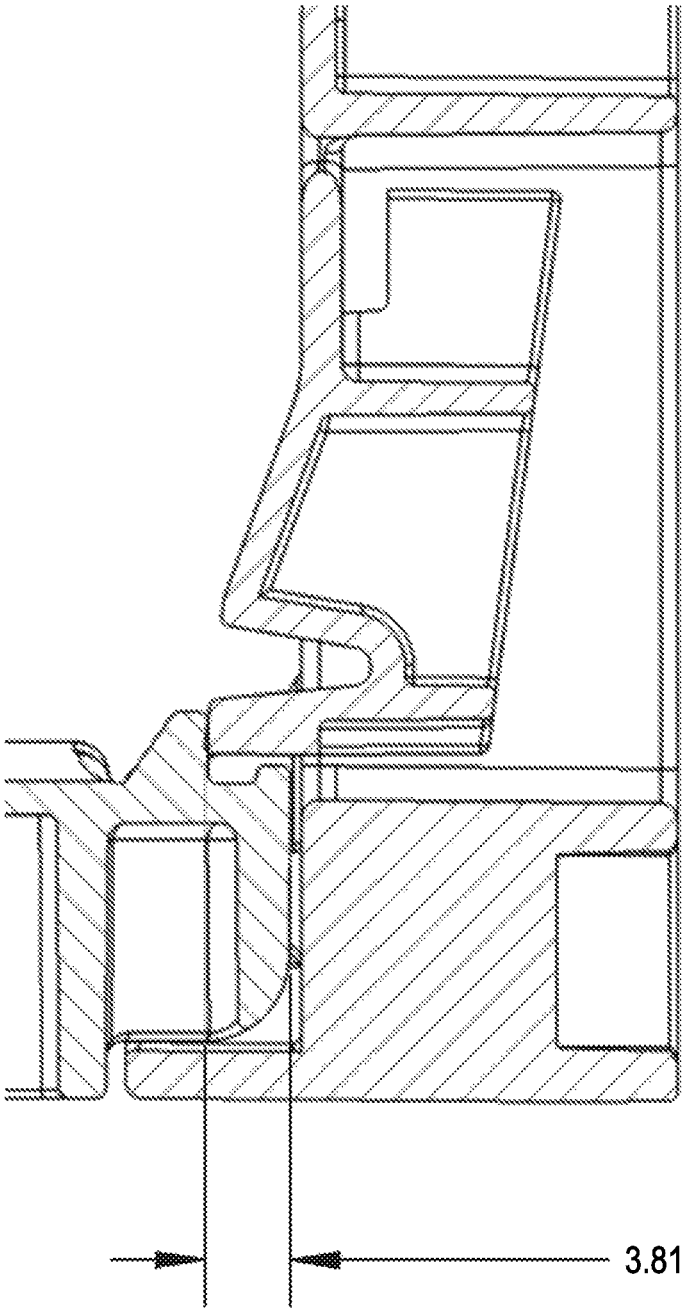
Figure 12E:
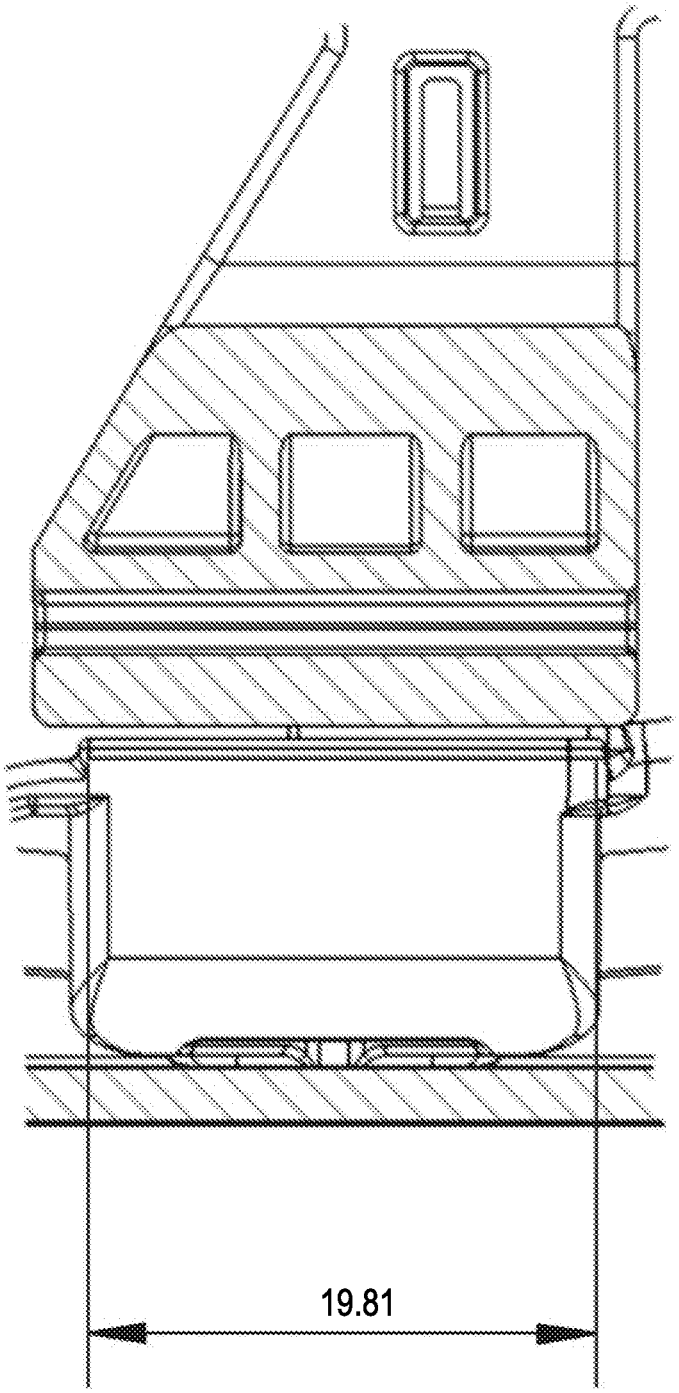

FIGS. 12A-12E show dimensions of one example of an embodiment of a latching system in a container according to aspects of the invention. FIG. 12A is a view of the latch similar to FIG. 4B; FIG. 12B is a side view of the latch from the interior side of the endwall; FIG. 12C is a side view of the latch from the exterior side of the endwall; FIG. 12D is a cross-section viewed downward, showing the endwall and sidewall interface; and FIG. 12E is a cross-section viewed from the inside of the container showing the endwall and sidewall interaction and the height over which the stop contacts the stop contact. The dimensions are shown in millimeters. The container including the latching system is made of the polypropylene material that is a nucleated impact copolymer sold under the name polypropylene 5720WZ by Total Petrochemicals USA, Inc. of Houston, Tex. The material has a measured flex modulus of about 184 ksi; a measured izod impact of about 1.91 ft-lb/in; and an elongation at break of about 110%.

Other suitable polypropylene materials for construction of other embodiments of a container comprising a latching according to the present invention include, for example, AP5325-HS from Huntsman Corporation of Woodlands, Tex.; 5720WZ or 4720WZ from Atofina Chemicals of Philadelphia, Pa.; PP7684KN from Exxon-Mobil Corporation of Irving, Tex.; and 3950 from Ineos Olefins and Polymers USA of Long Beach, Calif.

Modifications and changes to aspects of the invention described above should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

The invention claimed is:

1. A produce container, comprising:

A) a base;

B) four walls, each wall being coupled to the base by a corresponding hinge, a first wall of the four walls having a first lateral end and a second lateral end, and movable on its hinge about a first axis extending in a first direction parallel to the base, the first wall having a latch connected to the wall by a flexible arm at a first location proximate the first lateral end of the first wall, the latch comprising i) a latch body connected to the flexible arm and resiliently, outwardly movable in a second direction perpendicular to the first direction and parallel to the base when the container is in a substantially erected arrangement, the latch body having an interior surface that is sloped to partially face the second lateral end, ii) a stop contact having a contact surface perpendicular to the first direction in an unstressed state and resiliently movable about a third axis perpendicular to the first axis and the base, so as to allow the contact surface to partially face the interior when an inward force is applied to the contact surface, the stop contact connected to the latch body at a second location outward of where a stop contacts the contact surface when in the erected arrangement, a second wall of the four walls at the first lateral end of the first wall, and movable on its hinge about a second axis extending in the second direction, the second wall comprising the stop, the stop being rigidly attached to the second wall and aligned 1) to contact the contact surface as the second wall is rotated about the second axis from the erected arrangement toward the collapsed arrangement and 2) to contact the interior surface as the second wall is rotated about the second axis from the collapsed arrangement toward the erected arrangement.

2. The container of claim 1, wherein the stop comprises a leading edge positioned to contact the contact surface of the stop contact when the container is in an erected arrangement.

3. The container of claim 2, wherein the leading edge comprises a first projection to contact the contact surface, and a second projection extends around the contact surface.

4. The container of claim 2, further comprising an interlock formed at the first lateral end, the interlock comprising a first portion on the first wall and a second portion on the second wall, the interlock preventing outward rotation of the first wall and outward rotation of the second wall.

* * * * *